US008662701B2

(12) United States Patent
Sharrah et al.

(10) Patent No.: US 8,662,701 B2
(45) **Date of Patent: *Mar. 4, 2014**

(54) FLASHLIGHT HAVING A CONTROLLER PROVIDING PROGRAMMABLE OPERATING STATES

(71) Applicant: Streamlight, Inc., Eagleville, PA (US)

(72) Inventors: Raymond L. Sharrah, Collegeville, PA (US); Peter J. Ziegenfuss, Sellersville, PA (US); Mark W. Snyder, Hockessin, DE (US)

(73) Assignee: Streamlight, Inc., Eagleville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/751,652

(22) Filed: Jan. 28, 2013

(65) Prior Publication Data

US 2013/0135849 A1 May 30, 2013

Related U.S. Application Data

(60) Continuation of application No. 13/364,703, filed on Feb. 2, 2012, now Pat. No. 8,360,598, which is a division of application No. 12/509,726, filed on Jul. 27, 2009, now Pat. No. 8,110,760, which is a division of application No. 11/734,598, filed on Apr. 12, 2007, now Pat. No. 7,674,003.

(60) Provisional application No. 60/793,597, filed on Apr. 20, 2006.

(51) Int. Cl.
*F21L 4/04* (2006.01)
*H01H 9/00* (2006.01)

(52) U.S. Cl.
USPC ..... 362/205; 362/204; 362/206; 200/1 B; 200/302.2

(58) Field of Classification Search
USPC ..... 362/204–206; 200/60, 302.2, 1 B
See application file for complete search history.

(56) References Cited

U.S. PATENT DOCUMENTS 1,538,992 A 5/1925 Hopkins
1,964,467 A 6/1934 Hunter et al.

(Continued)

FOREIGN PATENT DOCUMENTS

DE 20006963 U1 8/2000
DE 10161017 A1 6/2003

(Continued)

OTHER PUBLICATIONS

Snaptron Inc., "Metal domes, snap domes and tactile dome switches for membrane and momentary switches", www.snaptron.com, for "DT Series low profile double action dome contact", © 2003-2006, 6 pages.

(Continued)

*Primary Examiner* — Anabel Ton
(74) *Attorney, Agent, or Firm* — Clement A. Berard, Esq.; Dann, Dorfman, Herrell & Skillman, PC

(57) ABSTRACT

An electrical light or flashlight may comprise: a housing for receiving a battery; an electrical light source in the housing; an electrical switch including an electrically conductive flexible dome providing a switch contact; a controller for selectively energizing and de-energizing the electrical light source, wherein said controller is programmable responsive to closures or openings or both of the electrical switch, or to a time therebetween, or to continuous closure or opening thereof, or to a combination thereof, for operating the light source in predetermined operating states.

20 Claims, 5 Drawing Sheets

(56) References Cited

U.S. PATENT DOCUMENTS 2,530,913 A 11/1950 Shackel
3,941,964 A 3/1976 Yoder
4,001,803 A 1/1977 Lombardo
4,074,122 A 2/1978 Moore
4,149,224 A 4/1979 King et al.
4,156,802 A 5/1979 Gilano et al.
4,228,485 A 10/1980 Hubbard et al.
4,274,130 A 6/1981 Elliott
4,329,039 A 5/1982 Kaneko
4,346,329 A 8/1982 Schmidt
4,439,646 A 3/1984 Bouvrande
4,649,323 A 3/1987 Pearlman et al.
4,652,216 A 3/1987 Eslinger et al.
4,764,708 A 8/1988 Roudeski
4,782,432 A 11/1988 Coffman
4,823,242 A 4/1989 Maglica et al.
4,831,504 A 5/1989 Nishizawa et al.
4,841,417 A 6/1989 Maglica et al.
4,864,474 A 9/1989 Maglica
4,905,129 A 2/1990 Sharrah
4,962,347 A 10/1990 Burroughs et al.
5,066,841 A 11/1991 Zoller et al.
5,121,308 A 6/1992 Maglica et al.
5,124,892 A 6/1992 Lambert
5,138,538 A 8/1992 Sperling
5,248,919 A 9/1993 Hanna et al.
5,268,826 A 12/1993 Greene
5,313,027 A 5/1994 Inoue et al.
5,359,779 A 11/1994 Polk
5,386,351 A 1/1995 Tabor
5,412,548 A 5/1995 Yee
5,418,433 A 5/1995 Nilssen
5,432,689 A 7/1995 Sharrah et al.
5,486,432 A 1/1996 Sharrah et al.
5,541,822 A 7/1996 Bamber
5,629,105 A 5/1997 Matthews
5,682,558 A 10/1997 Kirigaya et al.
5,749,646 A 5/1998 Brittell
5,790,013 A 8/1998 Hauck
5,806,961 A 9/1998 Dalton et al.
5,822,905 A 10/1998 Teetzel
5,839,821 A 11/1998 LeZotte
5,871,272 A 2/1999 Sharrah et al.
5,898,147 A 4/1999 Domzalski et al.
5,907,138 A 5/1999 Metzler
6,000,811 A 12/1999 Bordak
6,004,004 A 12/1999 Altman et al.
6,017,129 A 1/2000 Krietzman
6,024,471 A 2/2000 McDermott
6,040,660 A 3/2000 Schmidt et al.
6,045,237 A 4/2000 Parsons et al.
6,046,572 A 4/2000 Matthews
6,095,661 A 8/2000 Lebens et al.
6,184,794 B1 2/2001 Tucholski
6,184,930 B1 2/2001 Mitsuhashi et al.
6,186,641 B1 2/2001 Parker
6,190,018 B1 2/2001 Parsons et al.
RE37,092 E 3/2001 Sharrah et al.
6,222,138 B1 4/2001 Matthews et al.
6,224,235 B1 5/2001 Parker
6,239,555 B1 5/2001 Rachwal
6,249,089 B1 6/2001 Bruwer
6,259,862 B1 7/2001 Marino et al.
6,283,609 B1 9/2001 Parsons et al.
6,296,367 B1 10/2001 Parsons et al.
6,296,371 B1 10/2001 Shiau
6,305,818 B1 10/2001 Lebens et al.
6,307,328 B1 10/2001 Ko et al.
6,316,880 B1 11/2001 Broadhurst
6,357,893 B1 3/2002 Belliveau
6,386,730 B1 5/2002 Matthews
6,388,390 B2 5/2002 Rachwal
6,431,908 B1 8/2002 Beck et al.
6,435,689 B2 8/2002 Pitts
6,474,833 B1 11/2002 Parsons et al.
6,488,388 B2 12/2002 Jones
6,488,390 B1 12/2002 Lebens et al.
6,504,708 B2 1/2003 Yehudai
6,533,436 B2 3/2003 Krietzman et al.
6,534,926 B1 3/2003 Miller et al.
6,545,239 B2 4/2003 Spedale et al.
6,593,909 B1 7/2003 Chou
6,611,697 B1 8/2003 Ewing et al.
6,616,296 B1 9/2003 Roux et al.
6,621,225 B2 9/2003 Bruwer
6,623,140 B2 9/2003 Watterson et al.
6,635,832 B1 10/2003 Oster et al.
6,641,279 B1 11/2003 Williams
6,650,066 B2 11/2003 Bruwer
6,659,621 B2 12/2003 Sharrah et al.
6,702,452 B2 3/2004 Jigamian et al.
6,747,218 B2 6/2004 Huseman et al.
6,755,549 B2 6/2004 Rogers et al.
6,786,616 B1 9/2004 Parsons
6,794,589 B2 9/2004 Kubat et al.
6,798,228 B2 9/2004 Cuevas
6,805,461 B2 10/2004 Witte
6,808,287 B2 10/2004 Lebens et al.
6,808,289 B2 10/2004 Reed
6,814,464 B2 11/2004 Galli
6,814,465 B2 11/2004 Forsythe
6,814,466 B2 11/2004 Parsons et al.
6,841,941 B2 1/2005 Kim et al.
6,866,400 B2 3/2005 Wood et al.
6,880,951 B2 4/2005 Yoon
6,893,140 B2 5/2005 Storey et al.
6,893,143 B2 5/2005 Opolka
6,896,392 B2 5/2005 Jigamian et al.
6,909,250 B2 6/2005 Jigamian et al.
6,942,365 B2 9/2005 Galli
6,952,084 B2 10/2005 Bruwer
6,966,677 B2 11/2005 Galli
6,971,762 B2 12/2005 Galli
6,976,766 B2 12/2005 Galli
6,979,104 B2 12/2005 Brass et al.
6,984,900 B1 1/2006 Bruwer
7,033,042 B2 4/2006 Lim
7,059,742 B2 6/2006 Chen
7,063,435 B2 6/2006 Dallas et al.
7,084,526 B2 8/2006 Bruwer
7,084,531 B2 8/2006 Bruwer
7,090,374 B2 8/2006 Arthur
7,119,459 B2 10/2006 Bruwer et al.
7,161,311 B2 1/2007 Mueller et al.
7,166,813 B2 1/2007 Soma et al.
7,186,002 B2 3/2007 Matthews et al.
7,293,893 B2 11/2007 Kim
RE40,027 E 1/2008 Matthews
7,334,915 B2 2/2008 Kim
7,393,120 B2 7/2008 Kang et al.
7,434,956 B2 10/2008 Matteis
7,441,920 B2 10/2008 Kang et al.
7,448,917 B2 11/2008 Liao et al.
7,492,063 B2 2/2009 Bayat
7,503,671 B2 3/2009 Kang et al.
7,540,625 B2 6/2009 Matthews
7,549,765 B2 6/2009 Kim et al.
7,652,216 B2 1/2010 Sharrah et al.
7,674,003 B2 * 3/2010 Sharrah et al. ..... 362/205
7,737,373 B2 6/2010 In et al.
7,738,229 B2 6/2010 Bayat
7,880,100 B2 2/2011 Sharrah et al.
7,883,243 B2 2/2011 Snyder
8,110,760 B2 * 2/2012 Sharrah et al. ..... 200/60
8,360,598 B2 * 1/2013 Sharrah et al. ..... 362/204
2002/0021573 A1 2/2002 Zhang
2002/0097576 A1 7/2002 Sharrah et al.
2003/0095408 A1 5/2003 Opolka
2003/0107885 A1 6/2003 Galli
2003/0123253 A1 7/2003 Krietzman et al.
2003/0223227 A1 12/2003 Levine
2004/0050188 A1 3/2004 Richards et al.
2004/0190288 A1 9/2004 Hsu
2004/0217655 A1 11/2004 Bruwer

(56) References Cited

U.S. PATENT DOCUMENTS

| | | | |
|---|---|---|---|
| 2004/0227409 | A1 | 11/2004 | Bruwer |
| 2005/0002186 | A1 | 1/2005 | Krieger et al. |
| 2005/0007777 | A1 | 1/2005 | Klipstein et al. |
| 2005/0024864 | A1 | 2/2005 | Galli |
| 2005/0063179 | A1 | 3/2005 | Niemann |
| 2005/0077837 | A1 | 4/2005 | Kim et al. |
| 2005/0083626 | A1 | 4/2005 | Bruwer |
| 2005/0121980 | A1 | 6/2005 | Bruwer |
| 2005/0122710 | A1 | 6/2005 | Kim |
| 2005/0122712 | A1 | 6/2005 | Kim |
| 2005/0122714 | A1 | 6/2005 | Matthews et al. |
| 2005/0128741 | A1 | 6/2005 | Matthews et al. |
| 2005/0140310 | A1 | 6/2005 | Bruwer |
| 2005/0237734 | A1 | 10/2005 | Krieger |
| 2005/0237737 | A1 | 10/2005 | Kim |
| 2006/0109655 | A1 | 5/2006 | Martin |
| 2006/0158884 | A1 | 7/2006 | Kim |
| 2006/0164828 | A1 | 7/2006 | Kim |
| 2007/0109774 | A1 | 5/2007 | Booty |
| 2007/0145912 | A1 | 6/2007 | Spartano et al. |
| 2007/0183152 | A1 | 8/2007 | Hauck et al. |
| 2007/0246335 | A1 | 10/2007 | Sharrah et al. |
| 2007/0247839 | A1 | 10/2007 | Matthews et al. |
| 2008/0055891 | A1 | 3/2008 | Mattheis |
| 2008/0180032 | A1 | 7/2008 | Kim et al. |
| 2009/0283390 | A1 | 11/2009 | Sharrah et al. |
| 2010/0033963 | A1 | 2/2010 | Maglica |
| 2010/0123417 | A1 | 5/2010 | Sharrah et al. |
| 2010/0176750 | A1 | 7/2010 | West |
| 2010/0177507 | A1 | 7/2010 | West |
| 2011/0095708 | A1 | 4/2011 | Sharrah et al. |

FOREIGN PATENT DOCUMENTS

| | | |
|---|---|---|
| DE | 20313781 U1 | 2/2004 |
| EP | 0207691 | 1/1987 |
| EP | 1848016 | 10/2007 |
| JP | 06267307 | 9/1994 |
| JP | 8007602 | 1/1996 |
| JP | 2002245895 | 8/2002 |
| JP | 2003331681 | 11/2003 |
| JP | 2005332664 | 12/2005 |
| KR | 1020060063721 | 6/2006 |
| KR | 20-0423038 | 8/2006 |
| WO | 01/60127 | 8/2001 |
| WO | 01/77575 | 10/2001 |
| WO | 01/97379 | 12/2001 |
| WO | 2005/047763 | 5/2005 |
| WO | 2005/060715 | 7/2005 |
| WO | WO 2005124805 | 12/2005 |
| WO | 2006/023402 | 3/2006 |

OTHER PUBLICATIONS

Patent Cooperation Treaty, International Application No. PCT/US2008/086433, "Notification of Transmittal of the International Search Report and the Written Opinion of the International Searching Authority, or the Declaration", Jul. 27, 2009, 11 pages.
Paul Rosenburg, "House Wiring 8th Edition Updated for the 2005 NEC", pp. 162-165 and 174-175, © 2004, 7 pages.
Terrell Croft, "American Electricians' Handbook 14th Edition", © 2002, 6 pages.
Roger W. Herrell, "Letter to Christopher Darrow, Esq. Re: Pelican Products Allegations regarding U.S. Patent No. 7,393,120", Oct. 31, 2008, 16 pages.
Military Office Resupply Express, "3 way Flashlight w/ Magnet", source http://www.usa-stationary.com/product_info.php?cPath=1500267_1500295&products_id=2510025&osCsid=10, printed Dec. 3, 2007, 1 page.
Los Angeles Police Department Issued Flashlight Specifications, Mar. 2, 2006, 3 pgs.
City of Los Angeles, California, "Quotation/Auction Event Details", Nov. 3, 2005, pp. 10-17, Flashlight/Accessories, LAPD, Custom-made, ID# City-EV00000100.
City of Los Angeles, California, "Quotation/Auction Event Details", Flashlight, Custom-made per LAPD Specs, ID# City-EV00000321, Mar. 6, 2006, 12 pgs.
City of Los Angeles, California, "Quotation/Auction Event Details", Flashlight, Custom-made per LAPD Specs, ID# City-EV00000189, Jan. 18, 2006, 12 pgs.
http://www.pelican.com/lights_detail.php?recordID=1830, 2006, 1 page.
http://www.pelican.com/lights_detail.php?recordID=1930, 2001, 2 pages.
http://www.pelican.com/lights_detail.php?recordID=2320, 2003, 2 pages.
http://www.pelican.com/lights_detail.php?recordID=2330, 2004, 2 pages.
http://www.pelican.com/lights_detail.php?recordID=2340, 2000, 2 pages.
http://www.pelican.com/lights_detail.php?recordID=2430, 2005, 1 page.
http://www.pelican.com/lights_detail.php?recordID=7050, 1990, 2 pages.
http://www.pelican.com/lights_detail.php?recordID=7060, 2007, 2 pages.
http://www.pelican.com/lights_detail.php?recordID=8040, 2000, 2 pages.
http://www.pelican.com/lights_detail.php?recordID=8050, 1999, 2 pages.
International Search Report, PCT/US2007/073464, dated Mar. 6, 2008, 6 pages.
International Search Report, PCT/US2007/072782, dated Mar. 20, 2008, 6 pages.
Office Action, Canadian Application No. 2,614,709, dated Mar. 6, 2008, 4 pages.
SureFire U2 Ultra LED Flashlight (including larger image), © 2001-2005, http://www.surefire.com/maxexp/main/co_disp/displ/prrfnbr/24187/sesent/00, Printed Dec. 1, 2005, 3 pages.
LED Lights Comparison Chart, Printed Dec. 5, 2005, 1 page, http://www.surefire.com/surefire/content/comparechart_LED.html.
Flashlight Reviews and LED Modifications, FlashlightReviews.com, "In2theLight Trio, 29 LED Flashlight", 7 pages (prior to Apr. 12, 2007).
European Patent Office, "Partial European Search Report for European Application No. 07251541", Jun. 18, 2007, 3 pages.
JPO and INPIT, www4.ipdl.inpit.go.jp. Machine Translation of JP2008-331681, including: description of drawings (1 page), drawings (4 pages), detailed description (10 pages) and claims (2 pages), printed Jul. 26, 2007.
European Patent Office, "European Search Report, including European Search Opinion for EP Application No. 07251641.2", Oct. 15, 2007, 9 pages.
Streamlight, "Stinger, PolyStinger, SuperStinger, StingerXT Operating Instructions", © 1998, 3pgs.
Smith & Wesson, "6 LED Galaxy Flashlight" http://www.polotmall.com/product/Smith- Wesson-6-LED-Galaxy-Flashlight/flashlights, printed Aug. 31, 2009, 5 pages.
INOVA, "T Series", http://www.inovalight.com/t.html, printed Aug. 31, 2009, 17 pages.
International Preliminary Report on Patentability, dated Jun. 22, 2010, of International Application No. PCT/US2008/086433.

* cited by examiner

FLASHLIGHT HAVING A CONTROLLER PROVIDING PROGRAMMABLE OPERATING STATES

This Application is a continuation of U.S. patent application Ser. No. 13/364,703 filed Feb. 2, 2012, noticed to issue on Jan. 29, 2013 as U.S. Pat. No. 8,360,598, which is a division of U.S. patent application Ser. No. 12/509,726 filed Jul. 27, 2009, now U.S. Pat. No. 8,110,760, which is a division of U.S. patent application Ser. No. 11/734,598 filed Apr. 12, 2007, now U.S. Pat. No. 7,674,003, which claims the benefit of the priority of U.S. Provisional Patent Application No. 60/793,597 filed Apr. 20, 2006, each of which is hereby incorporated herein by reference in its entirety.

The present invention relates to a flashlight and, in particular, to a flashlight providing programmable operating states. Programming may be effected by a switch programming a controller. The invention is applicable to a flashlight as well as to other devices and apparatus.

Many conventional flashlights are turned on and off using a pushbutton that actuates a mechanical switch mechanism that opens and closes one or more sets of electrical contacts. One conventional mechanical switch is a so-called "clicker switch" that has a ratcheting mechanism that operates similarly to that of a clicker-type ball-point pen—press once and it "clicks" ON, press again and it "clicks" OFF, thereafter alternating between a closed contact ("ON") and an open contact ("OFF") so that the light alternates between ON and OFF with each successive "click," i.e. actuation.

The conventional clicker switch mechanism can be constructed so that the electrical switch contacts close to make a connection before the clicker mechanism ratchets to sustain the contact closure, and to break the contact closure if the pushbutton is released without actuating the ratchet mechanism, thereby providing a momentary switch closure, in addition to the sequential ratcheted sustained on and off conditions.

Clicker switches have several advantages that have made them come into wide use, such as being very inexpensive and providing tactile feedback, i.e. a movement of the pushbutton that is felt by the person pressing the pushbutton for indicating that the switch mechanism has operated. In addition, clicker switches can have a "long stroke," i.e. the distance the pushbutton must be moved to actuate the switch can be relatively long so that it provides a definiteness of actuation and a good feel for a user.

Among the disadvantages of clicker-type switches is that they are relatively mechanically complex, having a spring-loaded rotating ratcheting mechanism, and so tend to be less reliable than is desired. While failure of the clicker ratcheting mechanism of a ball point pen that sells for much less than one U.S. dollar is of little concern because the pen can be easily and cheaply replaced, and such pen typically has no warranty, such is typically not the case when the ratcheting mechanism of a clicker switch of a flashlight fails.

Flashlights can be relatively expensive and so replacing a flashlight when its switch fails is not desirable. It is also undesirable that the reliability of a quality light be compromised by a cheap clicker switch. Repairing such flashlights can also be expensive and inconvenient, and can result in significant undesirable commercial effects for quality flashlights that are under a manufacturer's warranty or are sold under a trade mark that is recognized for a quality product.

In addition, where a flashlight is utilized by a person in certain businesses and professions, the failure of a light can be much more serious than an inconvenience. Particularly in the case of flashlights for use by police, fire, first responders, emergency personnel, military personnel, security personnel, and the like, expecting a flashlight or other appliance to operate when it fails to operate due to a switch failure could lead to life and property being placed at risk, if not to an injury, a loss of life and/or a destruction of property.

Some users may prefer a flashlight with a switch toward the rear (tail) thereof and other users may prefer a flashlight with the switch toward the head end thereof, and some may prefer a flashlight with a switch near the tail and a switch near the head thereof.

There is a need for a switch that can have a stroke and tactile feedback similar to that of a strictly mechanical switch, without having the problems experienced with mechanical switches. There is also a need for a switch for programming a controller of a light to plural predetermined operating states.

An electrical switch may comprise a first switch element including an electrically conductive first flexible dome for selectively making electrical connection to a first electrical conductor; a second switch element adjacent the first switch element, the second switch element including an electrically conductive second flexible dome for selectively making an electrical connection to a second electrical conductor; and an actuator movable for exerting force on the first and second switch elements, wherein the first flexible dome of the first switch element makes the electrical connection to the first electrical conductor when the actuator moves a first distance and wherein the second flexible dome of the second switch element makes the electrical connection to the second electrical conductor when the actuator moves a second distance in addition to the first distance.

An electrical switch may comprise a first switch element including an electrically conductive first flexible dome for selectively making electrical connection to a first electrical conductor, a second switch element adjacent the first switch element, the second switch element including an electrically conductive second flexible dome for selectively making an electrical connection to a second electrical conductor, the second switch element including a flexible electrical conductor adjacent the first switch element and the second flexible dome, an actuator movable for exerting force on the second switch element via a spring, and for exerting force on the first switch element via the spring and the second switch element.

According to another aspect, an electrical light or flashlight may comprise: a housing for receiving a battery; a source of light in the housing; an electrical switch including an electrically conductive flexible dome providing a switch contact; a controller for selectively energizing and de-energizing the electrical light source, wherein said controller is programmable responsive to closures or openings or both of the electrical switch, or to a time therebetween, or to continuous closure or opening thereof, or to a combination thereof, for operating the light source in predetermined operating states, and wherein the light source is selectively energizable and de-energizable in predetermined operating states responsive to the electrical switch.

BRIEF DESCRIPTION OF THE DRAWING

The detailed description of the preferred embodiment(s) will be more easily and better understood when read in conjunction with the FIGURES of the Drawing which include.

Figure 1:
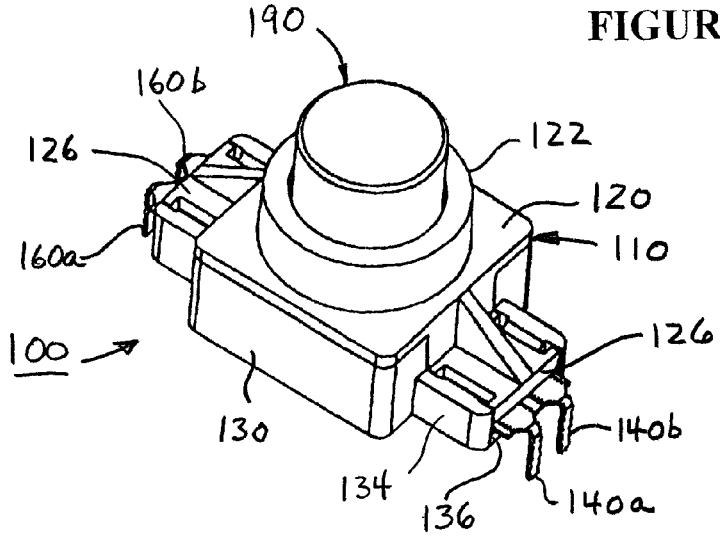
FIG. 1 is an isometric view of an example embodiment of a plural pole electrical switch.

In the Drawing, where an element or feature is shown in more than one drawing figure, the same alphanumeric designation may be used to designate such element or feature in each figure, and where a closely related or modified element is shown in a figure, the same alphanumerical designation primed may be used to designate the modified element or feature. Similarly, similar elements or features may be designated by like alphanumeric designations in different figures of the Drawing and with similar nomenclature in the specification. It is noted that, according to common practice, the various features of the drawing are not to scale, and the dimensions of the various features are arbitrarily expanded or reduced for clarity, and any value stated in any Figure is given by way of example only.

DESCRIPTION OF THE PREFERRED EMBODIMENT(S)

An electrical switch according to the present arrangement desirably provides plural sequential switching functions that are actuated via a pushbutton that can provide a relatively long stroke and can provide tactile feedback confirming its actuation. By a relatively long stroke is meant that the movement of the actuating button that is required to fully actuate all of the switch functions of the electrical switch is substantial, e.g., in relation to the size of switch.

In other words, the distance the actuator must travel (the "stroke") to actuate the switching elements of the switch may be substantially longer than is the actual distance that the switch elements must travel to be actuated, e.g., by about two times or more. The feature of providing a long stroke may be considered desirable because providing a significant distance of travel for actuation of a switch can provide a user of the switch with a perception that he may more easily control actuation, whereas the user might not feel in control over the small distance actually needed to actuate the switch elements. Long stroke may also be referred to as an extended stroke or enlarged stroke.

The feature of providing tactile feedback may be considered desirable in providing a perception of switch actuation to a user of the switch, so that the user might be able to "feel" or perceive the actuation of the switch elements, and thereby feel more in control of switch operation.

FIG. 1 is an isometric view of an example embodiment of a plural pole electrical switch 100. Electrical switch 100 comprises a housing 110 including a housing base 130 and a housing cover 120 that fits on housing base 130 preferably to define a substantially closed cavity therein. Actuating pushbutton 190 extends from a generally cylindrical section 122 of housing 110 in which it is movable toward and away from housing base 130 for actuating switch elements within housing 110.

Electrical connections to the contacts (poles) of switch elements internal to switch 100 are made via electrical leads 140*a*, 140*b* of a first switch pole that extend outward from housing base 130 in a first direction and via electrical leads 160*a*, 160*b* of a second switch pole that extend outward from housing base 130 in a second direction, e.g., through passages defined by respective races 136 of housing base 130 and race covers 126 of housing cover 120. Preferably, electrical leads 140*a*, 140*b*, 160*a*, 160*b* are bent downward, e.g., at about a right angle as illustrated, so as to extend past the bottom of housing base 130. Thus, switch 100 may conveniently be mounted to an electrical circuit board by inserting electrical leads 140*a*, 140*b*, 160*a*, 160*b* into corresponding holes in the electrical circuit board and soldering or otherwise affixing electrical leads 140*a*, 140*b*, 160*a*, 160*b* therein.

Typically, the switch poles provided at electrical leads 140*a*, 140*b* and at electrical leads 160*a*, 160*b*, are electrically insulated from each other and are actuated at different positions of and at different loads or forces applied to pushbutton 190, as is described below. Pushbutton 190 is preferably relatively long so that it has substantial travel distance outside of cylindrical section 122 of housing 110 so as to provide a long stroke.

The internal arrangement of the example embodiment of an electrical switch 100 is now described by reference to the exploded isometric view thereof shown in FIG. 2, and to the cross-sectional view thereof shown in FIG. 3. Housing 110 comprises a housing base 130 and a housing cover 120. Housing base 130 has a generally flat base 132 from which walls 138 extend to define a central cavity 139. Base 132 is, e.g., generally rectangular and has extensions 136 which with walls 134 define respective races or channels 136 extending outwardly from central cavity 139. In effect, channels or races 136 are openings in the walls 134, 138 of housing base 130. Housing cover 120 provides respective covers 126 that cooperate with races 136 to define passages through housing 110 through which electrical connections to switch elements 102, 104 therein may be provided.

Switch element 102 comprises a circuit board 140 and a flexible dome 150 thereon that are disposed in the central cavity 139 of housing base 130, typically with circuit board 140 adjacent base 132, and with electrical leads 140*a*, 140*b* thereof extending through one race 136. Specifically, circuit board 140 comprises a substrate 142 having an electrical conductor 144 around the periphery thereof and having a central electrical conductor 146 generally located centrally thereon, wherein electrical conductors 144 and 146 are not electrically connected together on substrate 142. Peripheral conductor 144 connects to electrical lead 140*a* and central conductor 146 connects to electrical lead 140*b*. Each of leads 140*a*, 140*b* is bent, e.g., at about a right angle, so as to be received into a hole in an electrical circuit board on which switch 100 is mounted and to be connected therein, e.g., by soldering.

Flexible dome 150 has a dome portion 152 and has a number of "feet" 154 extending therefrom, e.g., four feet 154. Flexible dome 150 is disposed adjacent to circuit board 140 with the feet 154 of flexible dome 150 in electrical contact with peripheral conductor 144 of circuit board 140, e.g., at or near the corners thereof, thereby to provide normally-open single-pole switch element 102. When a sufficient force or load is applied to dome 152 of flexible dome 150, the dome portion flexes (deflects) to come into electrical contact with central conductor 146 of circuit board 140, thereby to make electrical contact therewith and to close the switch element 102 formed by circuit board 140 and flexible dome 150. When sufficient force or load is not applied to flexible dome 150, or when such force or load is removed, flexible dome 150 returns to its unflexed (relaxed, undeflected) domed shape and is not in electrical contact with central conductor 146, thereby to open the switch element 102 formed by circuit board 140 and flexible dome 150.

Flexible dome 150 typically is a metal dome and has a "snap" action in that it tends to resist flexing until a certain force (sometimes referred to as a trip force or an actuation force) is applied, and then it flexes (deflects) relatively suddenly or snaps; likewise, flexible dome 150 also tends to unflex (return, relax, undeflect) relatively suddenly or snap to return to its unflexed or relaxed shape or form. As a result, the sudden flexing and unflexing of flexible dome 150 may be felt via pushbutton 190 thereby to provide tactile feedback of the operation of switch element 104.

Flexible dome 150 preferably flexes (deflects) at a relatively well defined force or load. For example, a flexible metal dome 150 having a 12 mm dome 152 may be provided that flexes (deflects) at a force of about 450 grams (about 1.0 lb.). Preferably, the flexing of dome 152 is relatively well defined in that it occurs relatively suddenly when the necessary level of force or load is applied so as to provide a tactile indication that flexing (deflection) has occurred.

Switch element 104 comprises a flexible circuit board 160 and a flexible dome 170 thereon that are disposed in the central cavity 139 of housing base 130, typically with flexible circuit board 160 adjacent switch element 102, and with electrical leads 160*a*, 160*b* thereof extending through the other race 136. Specifically, flexible circuit board 160 comprises a flexible substrate 162 having an electrical conductor 164 around the periphery thereof and having a central electrical conductor 166 generally located centrally thereon, wherein electrical conductors 164 and 166 are not electrically connected together on substrate 162. Peripheral conductor 164 connects to electrical lead 160*a* and central conductor 166 connects to electrical lead 160*b*. Each of leads 160*a*, 160*b* is bent, e.g., at about a right angle, so as to be received into a hole in an electrical circuit board on which switch 100 is mounted and to be connected therein, e.g., by soldering.

Flexible dome 170 has a dome portion 172 and has a number of "feet" 174 extending therefrom, e.g., four feet 174. Flexible dome 170 is disposed adjacent to flexible circuit board 160 with the feet 174 of flexible dome 170 in electrical contact with peripheral conductor 164 of flexible circuit board 160, e.g., at or near the corners thereof, thereby to provide normally-open single-pole switch element 104. When a sufficient force or load is applied to dome 172 of flexible dome 170, the dome portion flexes (deflects) to come into electrical contact with central conductor 166 of flexible circuit board 160, thereby to make electrical contact therewith and to close the switch element 104 formed by flexible circuit board 160 and flexible dome 170. When sufficient force or load is not applied to flexible dome 170, or when such force or load is removed, flexible dome 170 returns to its unflexed (undeflected) domed shape and is not in electrical contact with central conductor 166, thereby to open the switch element 104 formed by flexible circuit board 160 and flexible dome 170.

Flexible dome 170 typically is a metal dome and has a "snap" action in that it tends to resist flexing until a certain force (sometimes referred to as a trip force or an actuation force) is applied, and then it flexes (deflects) relatively suddenly or snaps; likewise, flexible dome 170 also tends to unflex (return, relax, undeflect) relatively suddenly or snap to return to its unflexed or relaxed shape or form. As a result, the sudden flexing and unflexing of flexible dome 170 may be felt via pushbutton 190 thereby to provide tactile feedback of the operation of switch element 102. In the present arrangement 100, however, the "snap" action of flexible dome 170 is attenuated or "muted" by the flexing of flexible circuit board 160, so that the snap action of flexible dome 170 tends to be felt, if at all, at pushbutton 190 as a relatively "soft" action rather than as a distinct snap. In other words, mechanical actuation is not as obvious to a user through his sense of touch.

Flexible dome 170 preferably flexes (deflects) at a relatively well defined force or load. For example, a flexible metal dome 170 having a 12 mm dome 172 may be provided that flexes (deflects) at a force of about 340 grams (about 0.75 lb.). Preferably, the flexing of dome 172 is relatively well defined in that it occurs relatively suddenly when the necessary level of force or load is applied so as to provide a tactile indication that flexing (deflection) has occurred.

Preferably, the force or load necessary to flex (deflect) flexible dome 170 is less than the force necessary to flex (deflect) flexible dome 150 so that when force or load is applied to the stack including switch elements 102 and 104, e.g., via spring 180, switch element 104 will actuate at a lower force or load than does switch element 102, thereby to provide an actuation sequence wherein switch element 104 actuates (dome 170 flexes or deflects) before switch element 102 actuates (dome 150 flexes or deflects) and a release sequence wherein switch element 104 de-actuates (dome 170 unflexes or returns) prior to switch element 102 de-actuating (dome 150 unflexing or returning).

In practice, force or load applied to the stack of switch elements 102, 104, via pushbutton 190 and spring 180 is transmitted to flexible circuit board 160 of switch element 104 which flexes and tends to conform to the shape of undeformed dome 152 of flexible dome 150. Thus, the actuation of switch element 104 is effected by the flexing of flexible dome 170, by the flexing of flexible circuit board 160 to move nearer to flexible dome 170, or both. Typically, this action provides reduced or attenuated tactile feedback to a user upon actuation of switch element 104 because the force or load necessary to continue activation after switch element 104 has actuated increases due to the higher force or load necessary to actuate switch element 102, but may not provide a perceived distinct snap.

In practice, while circuit board 140 need not be flexible, it may be convenient or economically desirable to make circuit boards 140 and 160 identical, i.e., both substrates 142 and 162 may be flexible substrates, and may have the same pattern of electrical conductors 144, 146 thereon. Because circuit board 140 abuts base 132 of housing base 130, operation of switch element 102 is not affected by whether the substrate 142 of circuit board 140 is or is not flexible. Typically, tactile feedback is provided at pushbutton 190 as a result of the snapping action of flexible dome 150 actuating switch element 102.

Housing cover 120 is disposed adjacent housing base 130 to retain switch elements 102, 104 in cavity 139. Housing cover 120 has a section 122 extending therefrom having an opening or bore 123 in which a pushbutton 190 is movable. Preferably, at least the interior 123 of section 122 of housing cover 120 is cylindrical as is the exterior cylindrical section 192 of pushbutton 190. A spring 180, preferably a coil spring 180, is compressed between pushbutton 190 and flexible dome 172 of switch element 104 so as to urge pushbutton 190 away from switch element 104. Pushbutton 190 may have an optional recess or cavity 196 in the end thereof to receive spring 180.

Preferably, cylindrical section 122 of housing cover 120 has an inwardly extending feature, e.g., an inwardly extending flange or ring 124, extending inwardly into opening 123 and pushbutton 190 has an outwardly extending feature, e.g., an outwardly extending flange or ring 194, that engages the inwardly extending feature 124 of housing cover 120 so as to retain pushbutton 190 in the opening or bore 123 of housing cover 120.

Housing cover 120 also includes race covers 126 extending therefrom in locations corresponding to the races 136 of housing base 130 so that when housing cover 120 and housing base 130 are placed together, the respective race covers 126 cover the respective races 136 to retain the extensions of circuit boards 140, 160, and their respective electrical leads 140*a*, 140*b*, 160*a*, 160*b*, therein, and to position switch elements 102, 104 in the cavity 139 of housing base 130 proximate to the base 132 thereof.

In operation, switch 100 is actuated by force or load applied to pushbutton 190 in a direction that moves pushbutton 190 towards housing base 130 thereby tending to compress spring 180 and to exert force or load on switch elements 102 and 104. In the unactuated state, pushbutton 190 is moved away from switch elements 102, 104 by spring 180 so that flanges or rings 124, 194 of cover 120 and pushbutton 190, respectively, come into physical contact.

Pressing pushbutton 190 causes spring 180 to compress until the force spring 180 transmits to switch element 104 increases to the level necessary to cause flexible dome 170 and/or flexible circuit board 160 to flex so as to come into contact with each other. Because the force necessary to compress spring 180 is less than that necessary to flex (deflect) flexible domes 170 and 150, spring 180 compresses before flexible domes 170, 150 actuate, i.e. at a lower force or load. This compression of spring 180 before switch elements 102, 104 actuate allows switch 100 to provide a relatively long stroke, i.e. pushbutton 190 moves a relatively long distance in actuating switch elements 102, 104, which is generally considered desirable for the user.

Because the force necessary to flex (deflect) flexible dome 150 is greater than that necessary to flex (deflect) flexible dome 170, flexible dome 170 flexes (deflects) at a lower level of force so that switch element 104 actuates before switch element 102. In practice, because of the relatively higher actuating force of flexible dome 150, flexible dome 150 provides a relatively rigid domed structure behind flexible circuit board 160. It is believed that the force transmitted via spring 180 and flexible dome 170 to flexible circuit board 160 tends to cause flexible circuit 160 to distort and tend to conform to the shape of dome 150, and so the flexing of flexible dome 170 necessary for it to make contact with conductor 166 of flexible circuit 160 is less than that caused by the full force that would be necessary to cause flexible dome 170 to flex (deflect) if placed against a rigid backing. As a result, operation of switch element 104, i.e. to provide a closure of switch contacts between conductors 164, 166 at electrical leads 160*a*, 160*b*, presents a relatively "soft" actuation without a strong tactile feedback.

As additional force is applied to pushbutton 190 beyond that necessary to actuate switch element 104, that force is transmitted via compressing spring 180, flexible dome 170 and circuit board 160 to flexible dome 150 of switch element 102. Because the force necessary to compress spring 180 is less than that necessary to flex (deflect) flexible dome 150, spring 180 compresses before flexible dome 150 actuates, i.e. at a lower force. This compression of spring 180 before switch element 102 actuates allows switch 100 to provide a relatively long stroke, i.e. pushbutton 190 moves a relatively long distance in actuating switch element 102, which is generally desirable for the user.

When the full force necessary to cause flexible dome 150 to flex (deflect) is applied to pushbutton 190 and transmitted via compressing spring 180, flexible dome 170 and circuit board 160 to flexible dome 150, flexible dome 150 flexes (deflects) to come into contact with circuit board 140, thereby actuating switch element 102, i.e. to provide a closure of switch contacts between conductors 144, 146 at electrical leads 140*a*, 140*b*. Flexible dome 150 typically flexes (deflects) with a snap action, thereby providing a definite tactile indication that switch element 102 has actuated.

De-actuation or release of switch 100 after full actuation is as follows. As the force applied to pushbutton 190 is reduced, deactivation of switch elements 102, 104 occurs in the reverse order to the actuation thereof as described above. Specifically, switch element 102 de-actuates with flexible dome 150 returning to its unflexed or relaxed state with a snap action, thereby to break the electrical connection between electrical leads 140*a*, 140*b*, followed by switch element 104 de-actuating with flexible dome 170 returning to its unflexed or relaxed state, thereby to break the electrical connection between electrical leads 160*a*, 160*b*. The distance over which pushbutton 190 moves in de-actuation of switch 100 is the same as the distance it moves in actuation, thereby providing a relatively long stroke.

A relatively long stroke may be provided through the cooperation of switch elements 102 and 104, and spring 180, and in particular, the operating force levels of flexible domes 150, 170 of switch elements 102, 104 relative to the spring rate of spring 180. Reducing the spring rate of spring 180 tends to increase the stroke or travel of pushbutton 190. The flexibility of substrate 162 of switch element 104 also has an effect on the actuation of switch element 104. The material and thickness of flexible substrate 162 may be selected in conjunction with domes 150, 170 and spring 180 for a desired actuation, e.g., the tactile feel of the actuation of switch element 104. Selected flexible domes 150, 170, substrate 162 and spring 180 may be evaluated empirically to arrive at a desired actuation characteristic, e.g., a desired stroke distance and/or "feel."

In an example embodiment providing a long stroke, the mechanical travel to actuate switch elements 102 and 104 is only about 1.25 mm (about 0.05 inch), which is a very small distance for a human finger to move. However, the stroke or mechanical travel of pushbutton 190 needed to actuate switch elements 102 and 104 therein is about 3.75 mm (about 0.15 inch), i.e. about three times as long as the actual actuation travel of switch elements 102 and 104.

Also for example, the force necessary to actuate (i.e. snap) flexible dome 150 is preferably greater than that necessary to actuate flexible dome 170. In one example, the force necessary to actuate flexible dome 150 is about 1¼ to two times that necessary to actuate flexible dome 170. For example, spring 180 is relatively long so as to allow for a correspondingly relatively long stroke and the spring constant of spring 180 may be selected to be equal to approximately the sum of the actuation forces of flexible domes 150, 170 divided by the total length of travel of pushbutton 180.

It is noted that switch 100 may be operated with less than full actuation, i.e. with less than actuation of both of switch elements 102 and 104. In particular, pushbutton 190 may be depressed sufficiently to actuate switch element 104, but not to actuate switch element 102, which is thought to be relatively easier due to the relatively long stroke of the described arrangement. In such case, flexible dome 170 makes contact with circuit board 160 thereby to provide a switch closure at electrical leads 160*a*, 160*b*, without any change of the open circuit condition between leads 140*a*, 140*b* of switch element 102.

Typically, switch 100 could be mounted to an electronic and/or electrical circuit board including electronic and/or electrical circuits and/or components with which switch 100 cooperates for controlling certain functions. Alternatively, switch 100, 100' could be connected via wires or other conductors to such circuits and/or components.

In one example embodiment, a switch 100 includes a 12 mm (about 0.05 inch) tactile dome 170 actuatable at a force of about 340 grams (about 0.75 lb.), a 12 mm (about 0.05 inch) flexible dome 150 actuatable at a force of about 450 grams (about 1.0 lb.) and an about 7.6 mm (about 0.3 inch) long spring 180 having a spring rate of about 265-290 grams/mm (about 15-16 lbs/inch). The force necessary to actuate switch element 104 was measured at about 635 grams (about 1.4 lbs.) and the force necessary to by applied at pushbutton 190 actuate switch element 102 was measured at about 998 grams (about 2.2 lbs). The total travel of pushbutton 190 to actuate both switch elements 102 and 104 was about 3.6 mm (about 0.14 inch). The maximum travel of pushbutton 190 is about 4 mm (about 0.16 inch), which is in excess of about 30% of the about 129 mm (about 0.515 inch) height of the example switch 100.

Advantageously, the long stroke of the described example switch 100 and the distinctly different levels of force necessary to actuate switch elements 102 and 104 make it easy for a user to control the operation of switch 100 to actuate switch element 104 or to actuate both switch elements 102 and 104. Thus, a user should be able to easily control the depressing of pushbutton 190 so as to actuate the function or functions controlled by switch element 104 or to actuate the function or functions controlled by switch element 102.

While both switch elements 102 and 104 provide respective momentary single-pole switching operations, i.e. a single-pole electrical connection is made when the actuating button is pressed and the single-pole electrical connection is broken when the actuating pushbutton is released, and latching or other non-momentary operation maybe provided electronically as described below in relation to the circuit of FIG. 4, rather than by an unreliable mechanical ratchet as in conventional mechanical switch arrangements. As a result, both the "feel" of switch 100, including a long stroke and/or tactile feedback, and its control of operation of a flashlight or other apparatus, can be made to mimic that of a mechanical switch, e.g., a clicker switch, without incurring the disadvantages of a mechanical switch.

Figure 3:
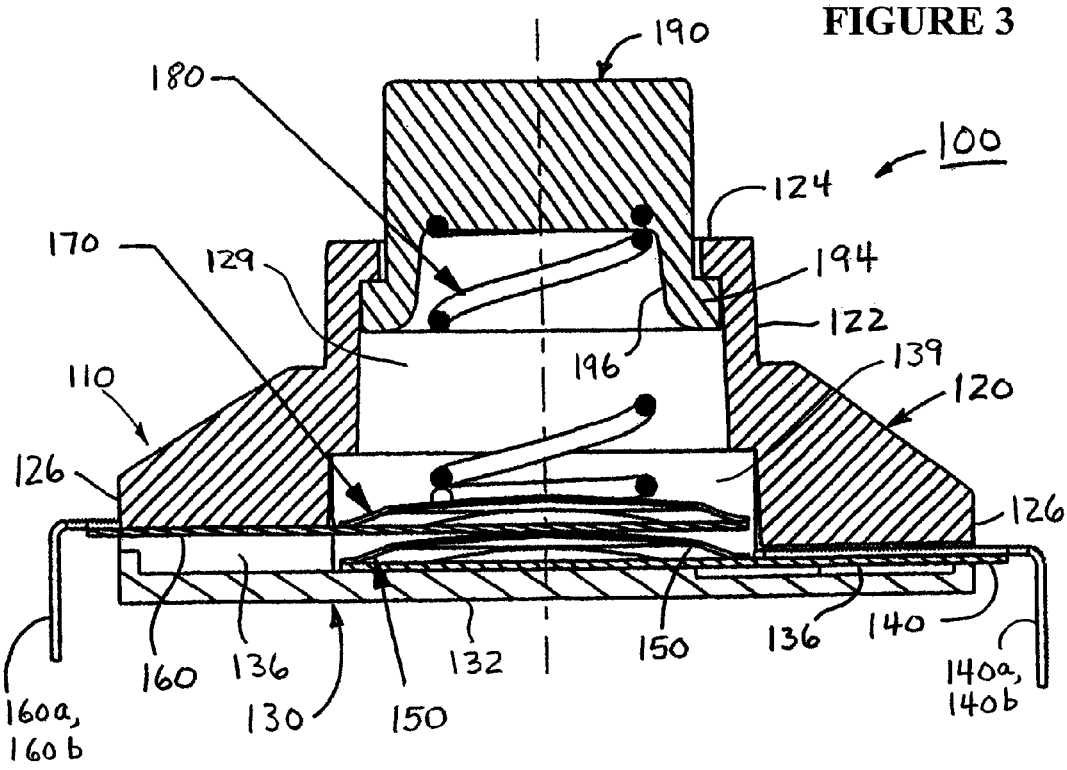
FIG. 3 is a cross-sectional view of the example embodiment of the plural pole electrical switch of FIGS. 1 and 2.
Figure 2:
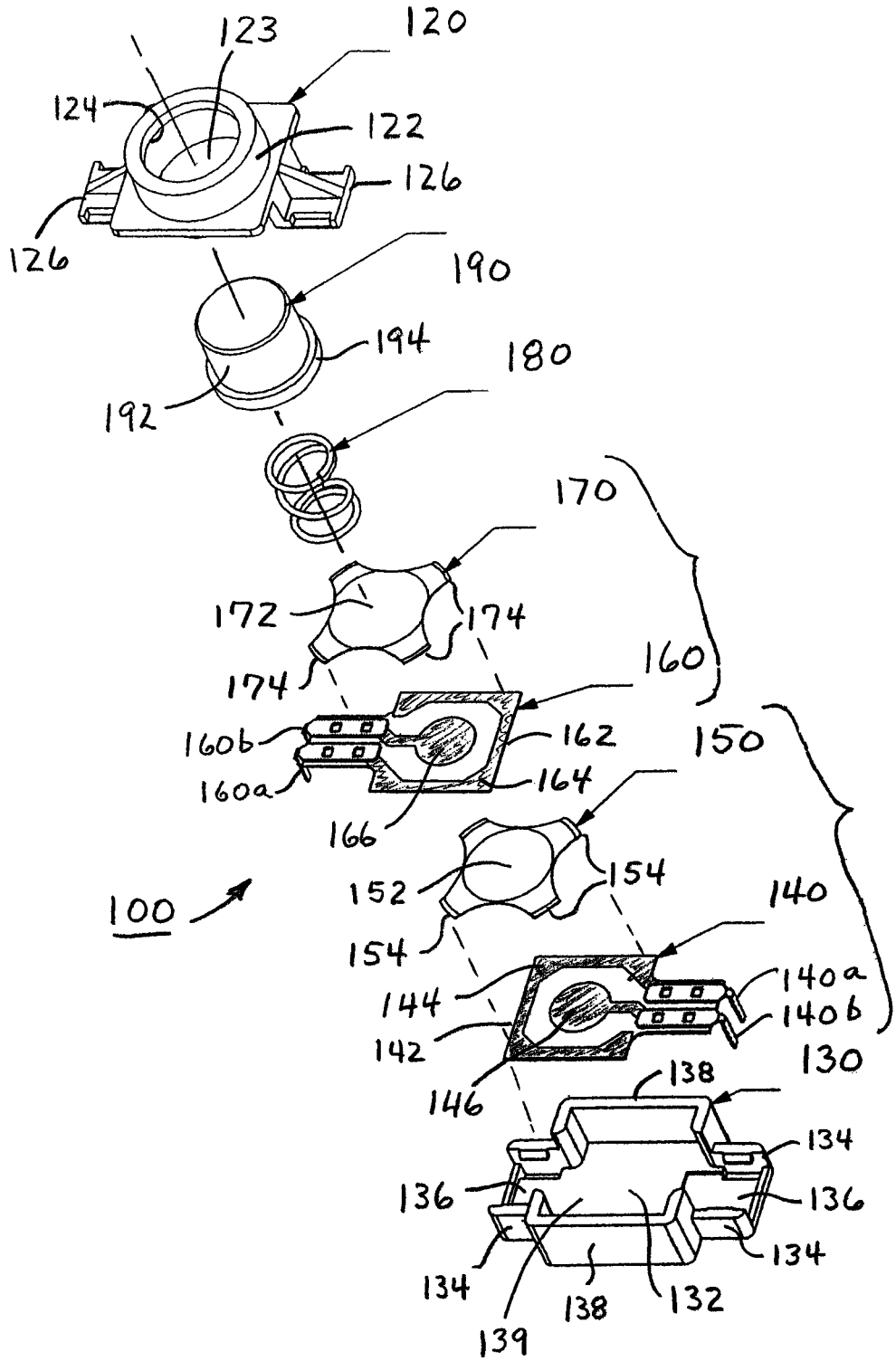
FIG. 2 is an exploded isometric view of the example embodiment of the plural pole electrical switch of FIG. 1.
Figure 4:
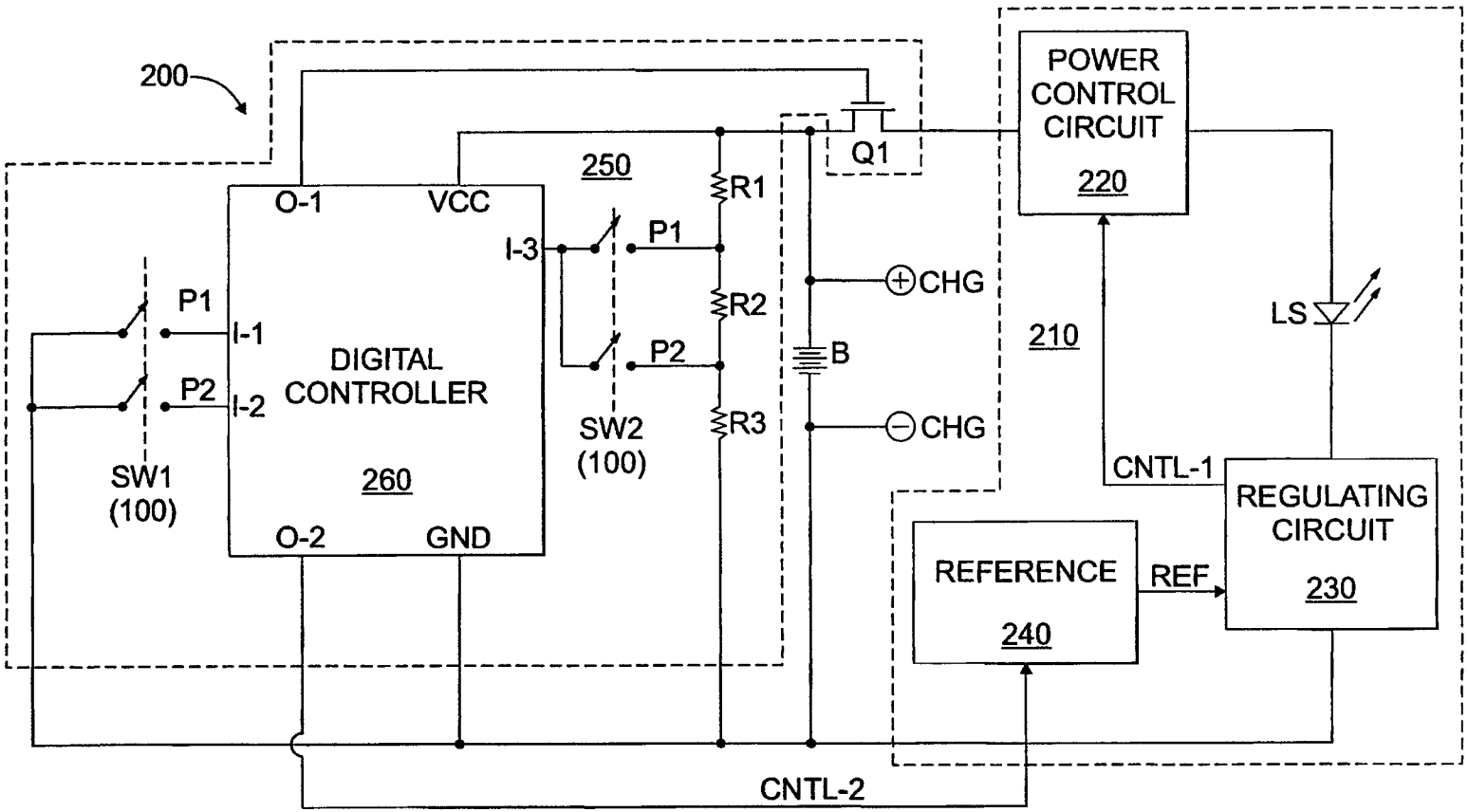
FIG. 4 is an electrical schematic diagram illustrating an example utilization of the example plural pole electrical switch of FIGS. 1, 2 and 3.

FIG. 4 is an electrical schematic diagram illustrating an example utilization of the plural pole electrical switch 100 of FIGS. 1, 2 and 3 in conjunction with an electronic control circuit 200. Circuit 200 includes a light section 210 that selectively couples electrical energy from battery B to a light source LS for selectively producing light, and a control section 250 for energizing and controlling light section 210 and the light produced thereby. Battery B may be a rechargeable battery with charging energy supplied via charging circuitry (not shown), which may be external or internal to light 10, to battery charging terminals ⊕ CHG and ⊖ CHG.

Light producing section 210, when energized by the switching element, e.g., transistor Q1, being rendered conducting, operates as follows. Power control circuit 220 receives electrical energy from battery B at the battery potential (less a small voltage drop across conducting transistor Q1) and provides electrical energy at a desired voltage and/or current to light source LS. The voltage and/or current provided to light source LS is controlled or regulated to a desired value by regulating circuit 230, and regulating circuit 230 also provides a control signal CNTRL-1 to power control circuit 220 for controlling its operation. Control signal CNTRL-1 may be a signal of regulating circuit 230 that is related to the error between the level of current through light source LS and the reference signal REF, and may be a variable continuous signal or may be a pulse-width modulated signal.

Where light source LS is a solid state light source, such as a light-emitting diode (LED), regulating circuit 230 preferably controls the level of current flowing through LED light source LS. In a particular example, regulating circuit 230 regulates LED light source LS current to a level determined by a reference level REF provided by reference source 240. In other words, the level of current flowing in light source LS is directly related to the reference level REF by operation of regulating circuit 230, and power control circuit 220 preferably controls the voltage provided to light source LS to the lowest value suitable for the desired operation of light source LS and regulating circuit 230. The order in which power control circuit 220, regulating circuit 230 and light source LS are connected in series across battery B may be changed as may be necessary or desirable for any particular embodiment.

Example circuits for a light section 210, for a power control 220, for a regulating circuit 230 and for a reference 240 that are suitable for use in an example light including the present switch arrangement, and their operation, are described in U.S. patent application Ser. No. 11/335,486 filed Jan. 19, 2006, entitled "ELECTRONIC CIRCUIT REDUCING AND BOOSTING VOLTAGE FOR CONTROLLING LED CURRENT" which is assigned to the assignee of the present Application and which is hereby incorporated herein by reference in its entirety.

Control section 250 energizes and controls light section 210 responsive to operation of switches SW1 and SW2, each of which may be a switch 100 as described herein. For both switch SW1 and switch SW2, pole P1 may correspond to switching element 104 of switch 100 and pole P2 may correspond to switching element 102 of switch 100, each of which provides a momentary single-pole, single-throw (SPST) switch. In a switch 100 as described herein, increasing pressure on the pushbutton actuator thereof first causes pole P1 to close and further increasing pressure then causes pole P2 to close, and releasing some of the pressure results in pole P2 opening and further releasing of the pressure then results in pole P1 opening. Holding a pressure after pole P1 has closed and before pole P2 has closed results in pole P1 remaining closed until the pressure is released and in pole P2 not closing.

In a portable lighting device, such as a flashlight, switches SW1, SW2 may be located at different locations on the device, e.g., switch SW1 could be located towards the head, front or light producing end of the device 200, and switch SW2 could be located towards the rear or non-light producing end of the device 200, e.g., in a tail cap as a tail cap switch. A lesser or greater number of switches may be utilized in any particular device, and any switch or switches SW1, SW2 may have a greater number or a lesser number of poles than that of the described example.

Each of switches SW1, SW2 connects to one or more inputs of controller 260 which responds to closures of the contacts of the respective poles P1 and P2 of switches SW1 and SW2 to render field-effect transistor Q1 conductive, i.e. into a low impedance conducting state, thereby to energize light section 210 and light source LS thereof, and to render transistor Q1 non-conductive, thereby to de-energize light section 210. Controller 260 receives its operating electrical power from battery B, e.g., between terminals designated as VCC and GND.

Closure of the respective contacts of poles P1 and P2 of switch SW1 provides respective connections from, e.g., inputs I-1, I-2 of controller 260 to, e.g., the negative terminal of battery B which controller 260 detects as activation of poles P1 and P2, respectively, of switch SW1. A voltage divider is formed by resistors R1, R2 and R3 being connected across battery B to provide different voltages at tap points at the connections of resistors R1, R2 and resistors R2, R3. Closure of the respective contacts of poles P1 and P2 of switch SW2 provides respective connections from, e.g., different tap points of the resistor R1, R2, R3 voltage divider to, e.g., an input I-3 of controller 260 which controller 260 detects as activation of poles P1 and P2, respectively, of switch SW2.

In response, controller 260 may control various functions of a light or other load in accordance with the programming with which it is provided for detecting and acting on closures of switches SW1 and SW2. Controller 260 may comprise dedicated circuits 260 that have a fixed predetermined response to various switch SW1, SW2 closures, e.g., direct acting circuits such as an amplifier and/or a flip flop. Alternatively, controller 260 or may comprise a digital controller or processor 260 that can provide a more sophisticated ability to interpret the closures of contacts of switches SW1 and SW2, e.g., in relation to time and/or frequency of switch closures as well as presence or absence of switch closures.

In one example embodiment, controller 260 may include a connection or a transistor or another switch that responds to closure of the pole P1 contacts of either switch SW1 or switch SW2 to apply a driving signal via output O-1 to the control electrode of transistor Q1 for rendering transistor Q1 conductive. Transistor Q1 becoming conductive energizes light section 210 for light source LS to produce light so long as pole P1 of SW1 or SW2 provides connection. When poles P1 of switches SW1 and SW2 are both open, transistor Q1 becomes non conductive and light source LS becomes de-energized. Thus, light source LS operates in a "momentary ON" mode in direct response to the closing of pole P1 of switch SW1 or of pole P1 of switch SW2 and in an "OFF" mode upon the opening of the respective poles P1 of both switch SW1 and switch SW2.

Further, in that example, controller 260 may include a toggling type flip-flop that responds to closure of the pole P2 contacts of either switch SW1 or switch SW2 to toggle, e.g., alternate, between first and second states. In the first state, for example, transistor Q1 may be OFF and in the second state a driving signal may be applied to the control electrode of transistor Q1 for rendering transistor Q1 conductive. Transistor Q1 becoming conductive energizes light section 210 for light source LS to produce light so long as the flip-flop remains in the second state and to not produce light when the flip-flop toggles to the first state. Thus, light source LS toggles back and forth between a "continuous ON" state and an OFF state in response to the successive closings and openings of pole P2 of switch SW1 or of switch SW2.

Thus, even though poles P1 and P2 or switches SW1 and SW2 are momentary SPST switches, controller 260 provides the additional function of latching, e.g., transforming a momentary switch closure into a continuous action, as far as a user is concerned, until a subsequent switch closure occurs. Controller 260 may similarly be configured to interpret the momentary switch closures as other types of functions, as may be convenient or desirable, thereby allowing additional features to be provided.

Additional features may be provided wherein controller 260, rather than simply implementing a single function in response to a switch closure, includes a digital controller or processor 260, e.g., such as a microprocessor 260. In such embodiment, digital processor 260 may be programmed to provide, for example, a momentary ON state, a continuous ON state, and an OFF state, of light source LS in response to closures and openings of poles P1 and P2 of switches SW1 and SW2 in like manner to that described in the preceding paragraphs. In addition, digital processor 260 may also be programmed to respond to other conditions of switches SW1, SW2, e.g., conditions based upon the number of actuations of a particular pole P1 and/or P2, the time between actuations of a particular pole P1 and/or P2, the time of continuous actuation of a particular pole P1 and/or P2, and/or combinations thereof. Further, a digital processor 260 may be programmed to provide a response to actuation of switch SW1 that differs from an identical actuation of switch SW2, or to a sequence of actuations according to which of switches SW1 and SW2 are actuated and the timing and ordering thereof.

In one example embodiment, a flashing light mode and a dimming mode may be provided by digital processor 260. For example, rapidly closing and opening poles P1 and P2 of either switch SW1 or switch SW2 two times in quick succession (e.g., "double clicking" switch SW1 or SW2) may be utilized to enter, for example, a flashing light state wherein light source LS alternates between producing light (ON) and not producing light (OFF) at a predetermined rate. In other words, quickly actuating either switch SW1 or switch SW2 within a short time period, e.g., within about 0.3 seconds, in a manner that would otherwise cause the light to enter or exit a continuous ON state, causes the light to operate in a flashing mode, with light source LS flashing ON and OFF, e.g., at an about 12 Hz or other desired rate.

The flashing of light source LS may be provided in any one of several ways. For example, digital processor 260 may cause its output O-1 to alternate between the ON and OFF levels at the predetermined flashing rate so that transistor Q1 alternates between conductive and non-conductive conditions at the predetermined flashing rate, thereby to cause power control 220 and regulating circuit 230 to apply and remove power from light source LS at the predetermined flashing rate. Alternatively, digital processor 260 may cause its output O-2 which controls reference source 240 to alternate between high and low levels at the predetermined flashing rate. This modulates reference source 240 to produce a reference signal REF that alternates between a high level and a very low level so that the current flowing in light source LS, which is directly related to the level of signal REF, alternates between a high level and a very low level, thereby to flash light source LS at the predetermined flashing rate.

For a light dimming mode, for example, the closing both poles P1 and P2 of either switch SW1 or of switch SW2 for an extended time (e.g., more than about one second) may be utilized to enter a light dimming mode wherein the current provided to light source LS is reduced during the time poles P1 and P2 are both closed (after the initial extended time). If the extended time is about one second, then continuing to keep the switch SW1 or SW2 in its actuated condition after about one second has elapsed results in the light produced by light source LS diminishing. Thereafter, releasing switch SW1, SW2 causes the light level to remain at whatever level it is at at the time when switch SW1, SW2 is released. The dimming mode may be exited by again closing poles P1 and P2 of either switch SW1 or SW2 in the manner for entering or leaving the continuous ON state.

The dimming of light source LS may be provided in any one of several ways. For example, digital processor 260 may cause its output O-2 which controls reference source 240 to decrease at a predetermined rate during the time that SW1 and/or SW2 is held closed. This modulates reference source 240 to produce a reference signal REF that decreases from a high level towards a very low level at a predetermined rate so that the current flowing in light source LS, which is directly related to the level of signal REF due to the regulating action of regulating circuit 230, decreases from a high level towards a very low or zero level, thereby to dim light source LS at the predetermined rate, as is preferred.

Alternatively, for example, digital processor 260 may provide dimming by causing its output O-2 to alternate between the high level and the low level in a pulse-width modulated manner at a frequency above that perceptible to the human eye so that the reference level REF alternates between the high level and the low level conditions at that frequency, thereby to cause reference source 240 to pulse width modulate the value of the reference REF and cause power control 220 and regulating circuit 230 to increase and decrease the light produced by light source LS at that frequency. The width of the pulse from output O-2 changing reference REF for changing the current in light source LS decreases at a predetermined rate so that the light output from light source LS, which is proportional to the average of the applied current, decreases at the predetermined rate. Alternatively, and preferably, reference source 240 may include a low-pass filter, e.g., a capacitor, for filtering the pulse-width modulated signal from output O-2 of controller 260 so that reference signal REF is proportional to the average thereof, thereby to control the current in light source LS to be proportional to the average of the pulse-width modulated output O-2.

Alternatively, for example, digital processor 260 may provide dimming by causing its output O-1 to alternate between the ON level and the OFF level in a pulse-width modulated manner at a frequency above that perceptible to the human eye so that transistor Q1 alternates between conductive and non-conductive conditions at that frequency, thereby to cause power control 220 and regulating circuit 230 to apply and remove power from light source LS at that frequency. The width of the pulse from output O-1 via transistor Q1 applying power to light source LS decreases at a predetermined rate so that the light output from light source LS, which is proportional to the average of the applied current, decreases at the predetermined rate.

It is noted that the decreasing and increasing of the control signals may be made at any desired rate and increment size. For example, the increment (step) size may be made relatively coarse so that each step of dimming and un-dimming produces a change in the level of light produced by light source LS that is evident to human perception. Alternatively, the size of the increments (steps) may be made finer so that individual steps of dimming and un-dimming are not perceived, and so the dimming and un-dimming appears to be smooth and continuous, rather than a sequence of perceivable steps.

In a preferred dimming operating mode, the light produced by light source LS is controlled in the dimming mode by controller 260 so that it does not extinguish, but maintains a relatively low-level of light output in response to the dimming actuation. Further, a preferred operation may be that, when switch SW1 or SW2 is actuated for a long time, the light output of light source LS first decreases to a relatively low level at the predetermined rate and then reverses and increases towards the normal light output at the predetermined rate, and continues alternatingly decreasing and increasing between the normal light level and the relatively low light level, so long as a switch SW1 or SW2 is maintained in the actuated condition with poles P1 and P2 closed. In a preferred operation, the increasing and decreasing of the light level of light source LS in the dimming mode may vary sinusoidally or in a sawtooth manner between the normal light level and the relatively low light level, e.g., at about four seconds per sinusoidal or sawtooth cycle.

Control of the light level produced by light source LS in the dimming mode is preferable provided by the output O-2 of digital processor 260 varying between a maximum value and a minimum value. While output O-2 could be varied in an analog or continuous manner, thereby to cause reference signal REF to vary in a corresponding continuous manner, it is preferred that output O-2 be a pulse-width modulated signal that varies between a maximum (e.g., 100%) on-time pulse width modulated signal corresponding to normal light output and a minimum on-time corresponding to the relatively low level light output (e.g., about 25% duty cycle). The discontinuous nature of this signal at output O-2 is preferably low-pass filtered in reference circuit 240, e.g., by a capacitor therein. Typically, the signal at output O-2 is pulse width modulated at about 50 KHz.

In the event that it might be desired to pulse-width modulate the current to light source LS, e.g., to not filter the reference potential in reference circuit 240, then the frequency of the pulse-width modulated signal preferably should be above a frequency at which, absent the capacitor, pulsing of light source LS output would be perceived by a human, e.g., above about 80-100 Hz.

At any point in the dimming cycle, release of switch SW1, SW2 causes the changing of the light output of light source LS to cease and maintains the then-present level of light output. The dimming mode of operation may be exited by depressing and releasing switch SW1 or SW2 to close and then open poles P1, and P2 thereof in the manner for entering or exiting the continuous ON condition.

Digital controller or processor 260 may be programmed to respond to closures of the respective poles of switches SW1 and SW2 in any desired manner and to provide any desired function or feature. By way of another example, in addition to momentary ON, continuous ON and OFF responses as described above, digital processor 260 could respond to closure of pole P1 of either SW1 or SW2 when light 100 is in the continuous ON state to provide a change in the brightness of the light produced. This dimming action could be in response to successive closures of a pole P1 to produce successive increments of changed brightness or could be in response to the time that a pole P1 is held closed. Increments of brightness change could be provided in any desired increment size, whether each increment is sufficiently large to be perceived by a human or not. Brightness change could be monotonic in that brightness dimming stops at a predetermined minimum brightness, which could include no light output, or could repetitively cycle down and up in brightness similar to that described above.

By way of another example, digital processor 260 could interpret two quick contact and release sequences of both poles P1 and P2 of SW1 or SW2, i.e. "double clicking," to enter a flashing light operation, or could respond to the number of such closures and/or the duration thereof to select one or more light sources to be energized from among plural light sources, or to select light sources of differing colors, or any other function that may be desired.

Typically, control circuit 200 could be provided on a circuit board to which one or more switches 100 are mounted, e.g., by connecting leads 140*a*, 140*b*, 160*a*, 160*b* to holes therein, or to which one or more switches 100 are connected, e.g., by wires, or by a combination thereof, and such circuit board could be disposed at any convenient location in a flashlight or other appliance utilizing circuit 200. In one example embodiment, a circuit board including circuit 200 is disposed in a flashlight housing 200 close behind the light source LS and the reflector in which it is disposed, and forward of the battery B cavity. One switch 100, e.g., switch SW1, may be disposed on the flashlight housing 200 in a relatively forward location and the other switch 100, e.g., switch SW2, may be disposed relatively rearward, such as in a tail cap.

Figure 5:
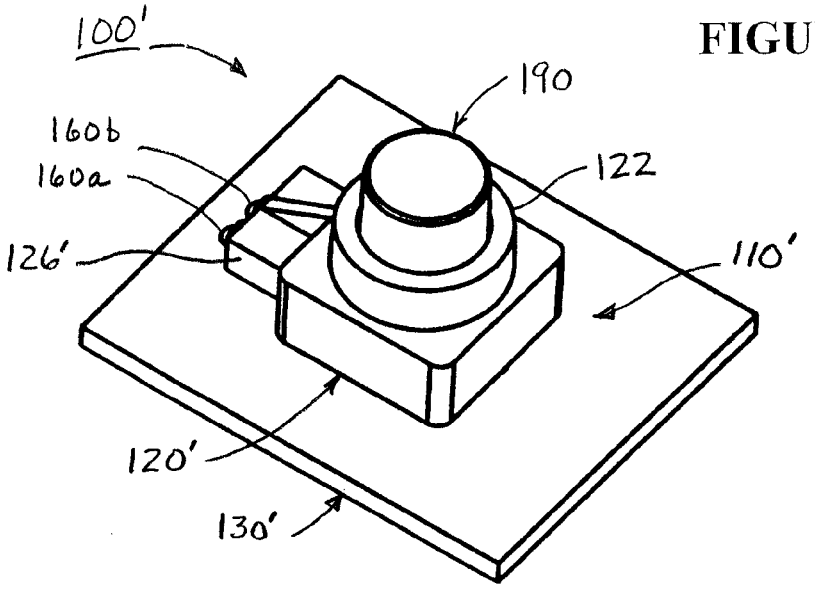
FIG. 5 is an isometric view of an example embodiment of a plural pole electrical switch.

FIG. 5 is an isometric view of an example embodiment of a plural pole electrical switch 100'. Electrical switch 100' comprises a housing 110' including a housing base 130' and a housing cover 120' that fits on housing base 130' preferably to define a substantially closed cavity 139' therein. Actuating pushbutton 190 extends from a generally cylindrical section 122 of housing 110' in which it is movable toward and away from housing base 130' for actuating switch elements within housing 110'.

Electrical connections to the contacts (poles) internal to switch 100' are made via electrical leads (not visible) of a first switch pole and via electrical leads 160*a*, 160*b* of a second switch pole that extend outward from housing base 130', e.g., through a passage defined by a race cover 126' of housing cover 120'. Preferably, electrical leads 160*a*, 160*b* are bent downward, e.g., at about a right angle as illustrated, so as to extend past the bottom of housing base 130'. Thus, switch 100' may conveniently be mounted to an electrical circuit board by inserting electrical leads 160*a*, 160*b* into corresponding holes in the electrical circuit board and soldering or otherwise connecting electrical leads 160*a*, 160*b* therein. Alternatively, and in some cases preferably, housing base 130' may be an electrical circuit board to which the leads 160*a*, 160*b* of the switch element 104 connects.

Typically, the switch poles provided at respective electrical leads are electrically insulated from each other and are actuated at different positions of and at different loads or forces applied to pushbutton 190, as is described below. Pushbutton 190 is preferably relatively long so that it can have substantial travel distance outside of cylindrical section 122 of housing 110' so as to provide a long stroke.

Electrical switch 100' is similar to electrical switch 100 in almost all respects, including the operation thereof, except that the arrangement providing housing base 130' and switch element 102' is different from the arrangement of housing base 130 and switch element 102 of switch 100, as will be described below.

Figure 7:
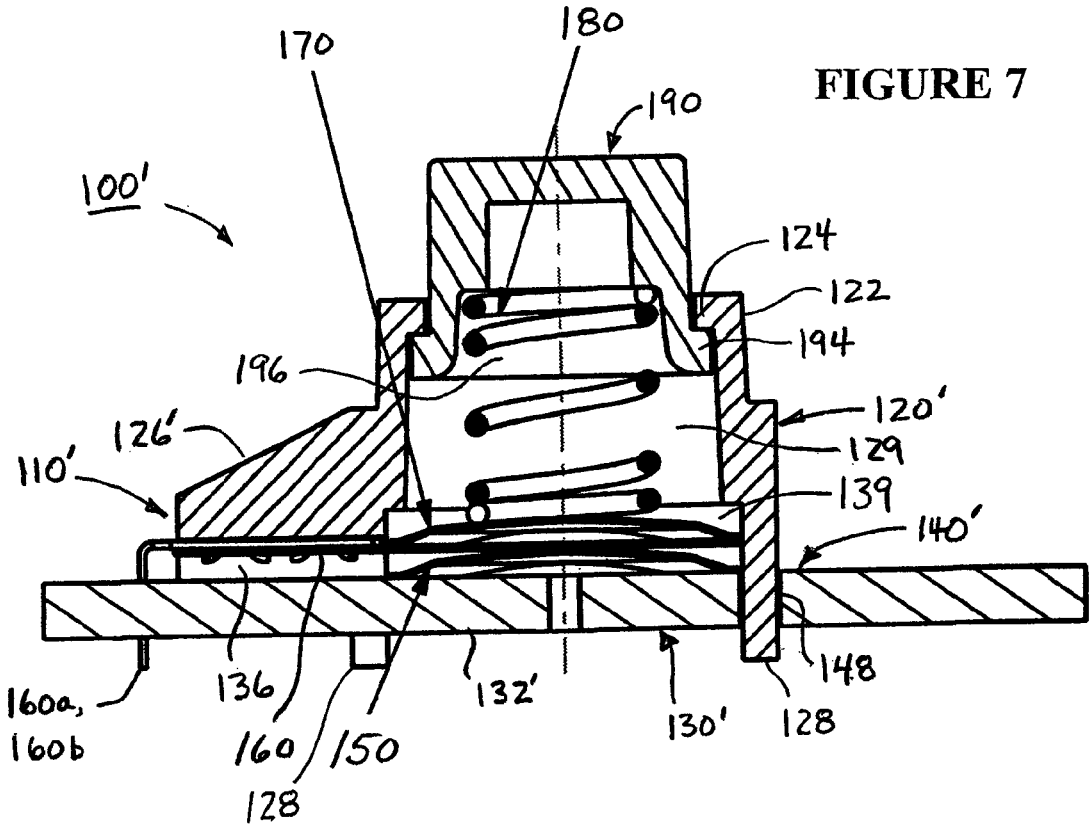
FIG. 7 is a cross-sectional view of the example embodiment of the plural pole electrical switch of FIGS. 5 and 6.
Figure 6:
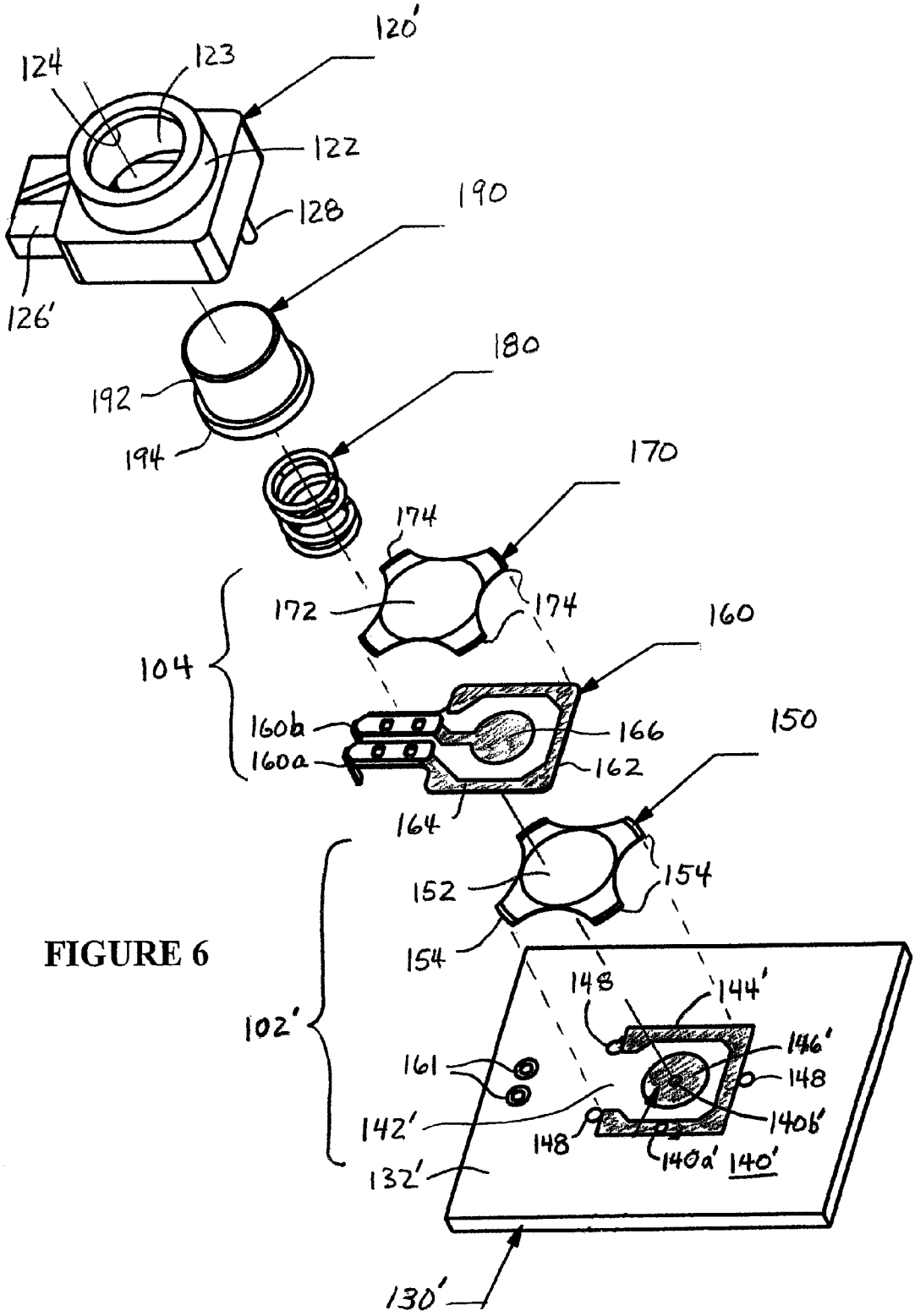
FIG. 6 is an exploded isometric view of the example embodiment of the plural pole electrical switch of FIG. 5.

The internal arrangement of the example embodiment of an electrical switch 100' is now described by reference to the exploded isometric view thereof shown in FIG. 6, and to the cross-sectional view thereof shown in FIG. 7. Housing 110' comprises a housing base 130' and a housing cover 120'. Housing base 130' has a generally flat base 132' that cooperates with housing cover 120' to define a central cavity 139', and housing base 130' also provides a substrate for switch element 102'. Base 132' is, e.g., generally rectangular, but may be of any convenient shape and size.

A portion of housing base 130' cooperates with the race cover 126' of housing cover 120' to define a passage extending outwardly from central cavity 139'. In effect, channel or race 126' provides an opening in the walls of housing cover 120' that cooperates with housing base 130' to define a passage through housing 110' through which electrical connections to switch element 104 within housing 110' may be provided. A passage through housing 110' through which electrical connections to switch element 102' therein may be made is provided by openings (e.g., vias) 140*a*, 140*b* in substrate 132' of housing base 130', but could be provided by another opening similar to that defined by race 126', if desired.

Switch element 102' comprises a circuit board 140' and a flexible dome 150 thereon that are disposed in the central cavity 139' of housing 110', typically with circuit board 140' having a substrate 142' provided by base 132' of housing base 130'. Electrical leads of switch element 102' may be provided by holes 140*a*', 140*b*', e.g., such as by plated vias or plated through holes connecting to electrical conductors on substrate 142', and/or by conductors that extend through the passage (vias) provided by holes 140*a*', 140*b*'. Thus, substrate 132' of housing base 130' provides a substrate 142' for circuit board 140' of switch element 102'.

Specifically, circuit board 140' comprises a substrate 142' having an electrical conductor 144' defining a periphery and having a central electrical conductor 146' generally located centrally therein, wherein electrical conductors 144' and 146' are not electrically connected together on substrate 142'. Peripheral conductor 144' connects to electrical lead 140*a*' and central conductor 146 connects to electrical lead 140*b*'. Each of leads 140*a*', 140*b*' may be provided by a plated through hole in electrical circuit board 140' and/or may be connected by soldering. Other electrical conductors and or electrical and electronic components may be provided on circuit board 140' as may be desired, and may connect to conductors 144', 146' of switch 102' by conventional printed wiring or other methods.

Flexible dome 150 has a dome portion 152 and has a number of "feet" 154 extending therefrom, e.g., four feet 154. Flexible dome 150 is disposed adjacent to circuit board 140' with the feet 154 of flexible dome 150 in electrical contact with corners of peripheral conductor 144' of circuit board 140', thereby to provide normally-open single-pole switch element 102'. Circuit board 140' and flexible dome 150 respond to the application of force or load to dome 152 of flexible dome 150, and to the removal of force or load, in like manner to that described herein in relation to switch element 102. In other words, switch element 102' typically operates and has characteristics similar to switch element 102, including having a "snap" action.

Switch element 104 comprises a flexible circuit board 160 and a flexible dome 170 thereon that are disposed in the central cavity 139' of housing 110', typically with flexible circuit board 160 adjacent switch element 102', and with electrical leads 160*a*, 160*b* thereof extending through a passage defined by race 126' of housing cover 120' and housing base 130'. Switch element 104 is substantially the same as switch element 104 described herein in relation to switch 100.

Preferably, as for switch 100, the force or load necessary to flex (deflect) flexible dome 170 of switch 100' is less than the force necessary to flex (deflect) flexible dome 150 so that when force or load is applied to the stack including switch elements 102' and 104, e.g., via spring 180, switch element 104 will actuate at a lower force or load than does switch element 102', thereby to provide an actuation sequence wherein switch element 104 actuates (dome 170 flexes or deflects) before switch element 102' actuates (dome 150 flexes or deflects) and a release sequence wherein switch element 104 de-actuates (dome 170 unflexes or returns) prior to switch element 102' de-actuating (dome 150 unflexing or returning).

In practice, force or load applied to the stack of switch elements 102', 104, via pushbutton 190 and spring 180 is transmitted to flexible circuit board 160 of switch element 104 which flexes and tends to conform to the shape of undeformed dome 152 of flexible dome 150, as described herein in relation to switch 100.

Housing cover 120' is disposed adjacent housing base 130' to cover cavity 139' and contain switch elements 102', 104 therein. Housing cover 120' has a section 122 extending therefrom having an opening or bore 123 in which a pushbutton 190 is movable against a spring 180, as described herein in relation to housing 120 of switch 100.

Housing cover 120' also includes walls defining at least one race 126', e.g., in a location similar to race cover 126 of housing cover 120 of switch 100, so that when housing cover 120' and housing base 130' of switch 100' are placed together, the race 126' and housing base 130' are adjacent to retain the extensions of circuit board 160, and its electrical leads 160*a*, 160*b*, therein, and to position switch element 104 in the cavity 139' of housing 110' proximate to flexible dome 150 which is adjacent housing base 130'.

Housing cover 120' may also include mounting posts 128 that extend in a direction toward a housing base (e.g., base 130', substrate 140') to which cover 120' is mounted, thereby to enclose switch elements 102, 104. Mounting posts 128 extend into corresponding openings 140 of housing base 130' and are typically fastened therein, e.g., by heat deformation where posts 128 are thermoplastic. When cover 120' is mounted to housing base 130', leads 160*a'* and 160*b'* of switch element 104 typically extend into holes 141 of substrate 140' and typically make electrical connection thereto.

Thus, the principal difference between the example embodiments of switch 100 and switch 100' involves the arrangement of housing covers 120, 120' and housing bases 130, 130' in providing housings 110, 110', respectively, and the providing of circuit board 140' of switch element 102' by housing base 130' of switch 100'.

In operation, switch 100' is actuated by force or load applied to pushbutton 190 in a direction that moves pushbutton 190 towards housing base 130' thereby tending to compress spring 180 and to exert force or load on switch elements 102' and 104 in the same manner as described herein in relation to switch elements 102, 104 of switch 100. The operation of switch 100', both in its actuating and de-actuating, and in actuating controller 260, is as described herein in relation to switch 100. Thus, switch 100' may provide a relatively long stroke, may provide a relatively soft tactile feedback upon actuation and de-actuation of switch element 104, and may provide a relatively distinct tactile feedback upon actuation and de-actuation of switch element 102'.

Because housing base 130' of switch 100' is a substrate 132', 142' having electrical conductors 144', 146' thereon to provide circuit board 140' on substrate 142', e.g., as printed conductors of a printed circuit, substrate 142' could also provide additional electrical conductors and electrical and/or electronic circuits and/or components thereon, e.g., those of the circuit 200 of FIG. 4 or part thereof.

An electrical switch 100, 100' may comprise a first switch element 102, 102' including: a first substrate 140, 142, 140' having at least a central electrical conductor 146, 146' and a peripheral electrical conductor 144, 144' thereon; an electrically conductive first flexible dome 150 disposed on first substrate 140, 142, 140' in electrical contact with peripheral electrical conductor 144, 144' thereof and overlying central conductor 146, 146' thereof, first flexible dome 150 having a given actuating force, wherein first flexible dome 150 comes into electrical contact with central electrical conductor 146, 146' of first substrate 140, 142, 140' when pressed towards first substrate 140, 142, 140' with the given actuating force; a second switch element 104 disposed adjacent first switch element 102, 102', second switch element 104 including: a flexible second substrate 160, 162 having at least a central electrical conductor 166 and a peripheral electrical conductor 164 thereon; an electrically conductive second flexible dome 170 disposed on flexible second substrate 160, 162 in electrical contact with peripheral electrical conductor 164 thereof and overlying central conductor 166 thereof, second flexible dome 170 having an actuating force that is less than the given actuating force of first flexible dome 150, wherein second flexible dome 170 comes into electrical contact with central electrical conductor 166 of flexible second substrate 160, 162 when pressed towards flexible second substrate 160, 162 with a force less than the given actuating force; and an actuator 190 disposed adjacent second switch element 104 and urged away therefrom by a spring 180 therebetween, wherein actuator 190 is movable for exerting force on second switch element 104 via spring 180, and for exerting force on first switch element 102, 102' via spring 180 and second switch element 104. Spring 180 may have a length that is substantially longer than an actuating distance of first and second flexible domes 150, 170. Electrical switch 100 may further comprise a housing base 130 having walls 138 defining a central cavity and defining at least two races 136 through the walls 138; and a housing cover 120 disposed adjacent housing base 130 for enclosing first and second switch elements 102, 104 therebetween. Housing cover 120 may have an opening 122 therethrough in which actuator 190 is movable and may include respective race covers 126 for the at least two races, wherein respective races 136 and race covers 126 define at least two passages through which electrical connection to the respective central and peripheral electrical conductors 146, 166, 144, 164 of first and second switch elements 102, 104 may respectively be made. Electrical switch 100, 100' may further comprise a housing base 130' providing first substrate 140' on which the central and peripheral electrical conductors 146', 144' of first switch element 102 are disposed; and a housing cover 120' disposed adjacent housing base 130', housing cover 120' may have walls 126' defining a central cavity and a passage through the wall, and may have an opening 122 therethrough in which actuator 190 is movable. First and second switch elements 102, 104 may be enclosed in the cavity between housing base 130' and housing cover 120', and electrical connection to central and peripheral electrical conductors 166, 164 of second switch element 104 may be made through the passage. Electrical switch 100, 100' may be in combination with a controller 260 and a load 210, wherein controller 260 may be responsive to first flexible dome 150 making contact between the central and peripheral electrical conductors 146, 146', 144, 144' of first switch element 102, to second flexible dome 170 making contact between the central and peripheral electrical conductors 166, 164 of second switch element 104, to first flexible dome 150 breaking contact between the central and peripheral electrical conductors 146, 146', 144, 144' of first switch element 102, to second flexible dome 170 breaking contact between the central and peripheral electrical conductors 166, 164 of second switch element 104, and to any combination of the foregoing, for controlling the load 210. Controlling the load 210 may include energizing load 210 momentarily, energizing load 210 continuously, de-energizing load 210, causing load 210 to alternate repetitively between energized and de-energized conditions, causing load 210 to change from a more energized condition to a less energized condition, causing load 210 to change from a less energized condition to a more energized condition, and any combination of the foregoing. Load 210 may be an electrical light source LS, and controller 260 may control light source LS to momentary ON, continuous ON, OFF, flashing, and dimming conditions, and optionally to an un-dimming operating condition.

An electrical switch 100, 100' may comprise a first switch element 102, 102' including an electrically conductive first flexible dome 150, first flexible dome 150 being flexible for selectively making electrical connection between a first pair of electrical conductors 144, 146, 144', 146', first flexible dome 150 having a given actuating force, a second switch element 104 disposed adjacent first switch element 102, 102', second switch element 104 including an electrically conductive second flexible dome 170, second flexible dome 170 being flexible for selectively making an electrical connection between a second pair of electrical conductors 164, 166, wherein the second pair of electrical conductors 164, 166 are flexible and are between second flexible dome 170 and first switch element 102, 102', second flexible dome 170 having an actuating force that is less than the given actuating force of first flexible dome 150, an actuator 190 disposed adjacent second switch element 104 and urged away therefrom by a spring 180 therebetween, wherein actuator 190 is movable for exerting force on second switch element 104 via spring 180, and for exerting force on first switch element 102, 102' via spring 180 and second switch element 104. The second pair of electrical conductors 164, 166 may be disposed on a flexible insulating substrate 160, 162 that is disposed between first and second flexible domes 150, 170. Spring 180 may have a length that is substantially longer than an actuating distance of first and second flexible domes 150, 170. Electrical switch 100,100' may further comprise a housing base 130 having walls 138 defining a central cavity and defining at least two races 136 through the walls 138; and a housing cover 120 disposed adjacent housing base 130 for enclosing first and second switch elements 102, 104 therebetween, housing cover 120 having an opening 122 therethrough in which actuator 190 is movable, housing cover 120 including respective covers 126 for the at least two races 136, wherein the respective races 136 and covers 126 define at least two passages through which first and second pairs of electrical conductors 144, 146, 164, 166 140*a*, 140*b*, 160*a*, 160*b* pass. Electrical switch 100, 100' may further comprise a housing base 130' providing a first substrate 140' on which first pair of electrical conductors 146', 144' are disposed; and a housing cover 120' disposed adjacent housing base 130', housing cover 120' having walls defining a central cavity and a passage 126' through the wall, and having an opening 122 therethrough in which actuator 190 is movable, wherein first and second switch elements 102', 104 are enclosed in the cavity between housing base 130' and housing cover 120', and wherein the second pair of electrical conductors 164, 166 pass through the passage through the wall of housing cover 120'. Electrical switch 100, 100' may be in combination with a controller 260 and a load 210, wherein controller 260 may be responsive to first flexible dome 150 making contact with the first pair of electrical conductors 144, 146, 144', 146', to second flexible dome 170 making contact with the second pair of electrical conductors 164, 166, to first flexible dome 150 breaking contact with the first pair of electrical conductors 144, 146, 144', 146', to second flexible dome 170 breaking contact with the second pair of electrical conductors 164, 166, and to any combination of the foregoing, for controlling the load 210. Controlling load 210 may include energizing load 210 momentarily, energizing load 210 continuously, de-energizing load 210, causing load 210 to alternate repetitively between energized and de-energized conditions, causing load 210 to change from a more energized condition to a less energized condition, causing load 210 to change from a less energized condition to a more energized condition, and any combination of the foregoing. Load 210 may include an electrical light source LS, and controller 260 may control light source LS to momentary ON, continuous ON, OFF, flashing, and dimming conditions, and optionally to an un-dimming operating condition.

An electrical switch 100, 100' may comprise a housing 120, 130, 120', 130' having walls defining a central cavity and defining at least two passages 136, 136' through the walls of housing 120, 130, 120', 130; a first switch element 102, 102' disposed in the central cavity of housing 120, 130, 120', 130' may include: a first substrate 140, 142, 140', 142' adjacent housing 120, 130, 120', 130', first substrate 140, 142, 140', 142' having at least a central electrical conductor 146, 146' and a peripheral electrical conductor 144, 144' thereon, wherein the central electrical conductor 144, 144' and the peripheral electrical conductor 146, 146' extend into or through or into and through a first of the at least two passages 136, 136; an electrically conductive first flexible dome 150 disposed on first substrate 140, 142, 140', 142' in electrical contact with the peripheral electrical conductor 144, 144' thereof and overlying the central conductor 146, 146' thereof, first flexible dome 150 having a given actuating force, wherein first flexible dome 150 comes into electrical contact with the central electrical conductor 146, 146' of first substrate 140, 142, 140', 142' when pressed towards first substrate 140, 142, 140', 142' with the given actuating force; a second switch element 104 disposed in the central cavity of housing 120' 130, 120', 130' adjacent first switch element 102, 102' may include: a flexible second substrate 160, 162 adjacent first switch element 102, 102', flexible second substrate 160, 162 having at least a central electrical conductor 166 and a peripheral electrical conductor 164 thereon, wherein the central electrical conductor 166 and the peripheral electrical conductor 164 extend into or through or into and through a second of the at least two passages 136, 136; an electrically conductive second flexible dome 170 disposed on flexible second substrate 160, 162 in electrical contact with the peripheral electrical conductor 164 thereof and overlying the central conductor 166 thereof, second flexible dome 170 having an actuating force that is less than the given actuating force of first flexible dome 150, wherein second flexible dome 170 comes into electrical contact with the central electrical conductor 166 of flexible second substrate 160, 162 when pressed towards flexible second substrate 160, 162 with a force less than the given actuating force; an actuator button 190 disposed in an opening of housing 120, 130, 120', 130' adjacent second switch element 104; and a coil spring 180 disposed between actuator button 190 and second switch element 104 for urging actuator button 190 away from second switch element 104, wherein actuator button 190 is movable in the opening 122 of housing 120, 130, 120', 130' for exerting force on second switch element 104 via coil spring 180, and for exerting force on first switch element 102, 102' via coil spring 180 and second switch element 104. Coil spring 180 may have a length that is substantially longer than an actuating distance of first and second flexible domes 150, 170. Housing 120, 130, 120', 130' may comprise: a housing base 130 having walls 138 defining the central cavity and defining at least two races 136 through the walls; and a housing cover 120 disposed adjacent housing base 130 for enclosing first and second switch elements 102, 102', 104 therebetween, housing cover 120 having an opening 122 therethrough in which actuator button 190 is movable, housing cover 120 including respective race covers 126 for the at least two races 136, wherein the respective races 136 and race covers 126 define the at least two passages. Housing 120' may comprise: a housing base 130' providing first substrate 140; and a housing cover 120' disposed adjacent housing base 130', housing cover 120' having walls defining the central cavity and at least one of the at least two passages, and having an opening 122 therethrough in which actuator button 190 is movable, wherein first and second switch elements 102', 104 are enclosed in the central cavity between housing base 130' and housing cover 120', and wherein either housing cover 120' provides a second of the at least two passages through the walls thereof or housing base 130' provides a second of the at least two passages through the first substrate 140' thereof. Electrical switch 100, 100' may be in combination with a controller 260 and a load 210, wherein controller 260 may be responsive to first flexible dome 150 making contact between the central and peripheral electrical conductors 146, 144, 146', 144' of first switch element 102, 102', to second flexible dome 170 making contact between the central and peripheral electrical conductors 166, 164 of second switch element 104, to first flexible dome 150 breaking contact between the central and peripheral electrical conductors 146, 144, 146', 144' of first switch element 102, 102', to second flexible dome 170 breaking contact between the central and peripheral electrical conductors 166, 164 of second switch element 104, and to any combination of the foregoing, for controlling the load 210. Controlling load 210 may include energizing load 210 momentarily, energizing load 210 continuously, de-energizing load 210, causing load 210 to alternate repetitively between energized and de-energized conditions, causing load 210 to change from a more energized condition to a less energized condition, causing load 210 to change from a less energized condition to a more energized condition, and any combination of the foregoing. Load may be an electrical light source LS, and controller 260 may control light source LS to momentary ON, continuous ON, OFF, flashing, and dimming conditions, and optionally to an un-dimming operating condition.

An electrical switch 100, 100' may comprise: a first switch element 102, 102' including an electrically conductive first flexible dome 150 for selectively making electrical connection to a first electrical conductor 146, 146' and having a first given actuating force; a second switch element 104 adjacent the first switch element 102, 102', the second switch element 104 including an electrically conductive second flexible dome 170 for selectively making an electrical connection to a second electrical conductor 166; wherein the second electrical conductor 166 is between the second flexible dome 170 and the first switch element 102, 102', the second flexible dome 170 having a second given actuating force; and an actuator 190 movable for exerting force on the second switch element 104 via a spring 180, and for exerting force on the first switch element 102, 102' via the spring 180 and the second switch element 104. The second given actuating force of second flexible dome 170 may be less than the first given actuating force of first flexible dome 150. Second electrical conductor 166 may be a flexible conductor. First flexible dome 150 and second flexible dome 170 may electrically connect to the second electrical conductor 166.

An electrical switch 100, 100' may comprise: a first switch element 102, 102' including an electrically conductive first flexible dome 150 for providing a first normally open switch contact and having a first given actuating force, a second switch element 104 adjacent the first switch element 102, 102', the second switch element 104 including an electrically conductive second flexible dome 170 for providing a second normally open switch contact and having a second given actuating force, the second switch element 104 including a flexible electrical conductor 160, 164, 166 between first switch element 102, 102' and the second flexible dome 170; and an actuator 190 movable for exerting force on the second switch element 104 via a spring 190, and for exerting force on the first switch element 102, 102' via the spring 190 and the second switch element 104, wherein the actuator 190 moves a distance for closing the first and second normally open contacts that is substantially longer than an actuating distance of first and second flexible domes 150, 170. The second given actuating force of second flexible dome 170 may be less than the first given actuating force of first flexible dome 150. First flexible dome 150 and second flexible dome 170 may electrically connect to the flexible electrical conductor 160, 164, 166.

An electrical switch 100, 100' may comprise: a first switch element 102, 102' including an electrically conductive first flexible dome 150 for providing a first normally open switch contact and having a first given actuating force, a second switch element 104 adjacent the first switch element 102, 102', the second switch element 104 including an electrically conductive second flexible dome 170 for providing a second normally open switch contact and having a second given actuating force, the second switch element 104 including a flexible electrical conductor 160, 164, 166 between the first switch element 102, 102' and the second flexible dome 170; a controller 260 responsive to closure, or opening, or both, of the first normally open switch contact and of the second normally open switch contact for controlling electrical power to a load 210; and an actuator 190 movable for exerting force on the second switch element 104 via a spring 180, and for exerting force on the first switch element 102, 102' via the spring 180 and the second switch element 104, wherein the actuator 190 moves a distance for closing the first and second normally open contacts that is substantially longer than an actuating distance of the first and second flexible domes 150, 170. Controlling electrical power to the load 210 may include energizing the load 210 momentarily, energizing the load 210 continuously, de-energizing the load 210, causing the load 210 to alternate repetitively between energized and de-energized conditions, causing the load 210 to change from a more energized condition to a less energized condition, causing the load 210 to change from a less energized condition to a more energized condition, and any combination of the foregoing. Load 210 may include an electrical light source LS, and controller 250 may control the light source LS to momentary ON, continuous ON, OFF, flashing, and dimming conditions, and optionally to an un-dimming operating condition.

An electrical switch 100, 100' for a flashlight 200 including a housing 200 having a head end and a tail end and having a cavity for receiving a battery B, and an electrical light source LS disposed proximate the head end of the housing 200, electrical switch 100, 100' may comprise: a first pushbutton switch SW1 disposed proximate the head end of the housing 200 for providing at least a first switch contact P1, P2; a second pushbutton switch SW2 disposed proximate the tail end of the housing 200 for providing at least a second switch contact P1, P2; a controller 260 disposed in the housing 200 and electrically connected to the electrical light source LS and to the battery B when a battery B is provided in the cavity of the housing 200 for selectively coupling electrical power from the battery B to the electrical light source LS, wherein controller 260 is electrically connected to first pushbutton switch SW1 and is responsive to closure, or opening, or both, of the first switch contact P1, P2 for controlling electrical power to the electrical light source LS at least for selectively energizing and de-energizing the electrical light source LS when the battery B is present in the cavity of the housing 200, and wherein controller 260 is electrically connected to second pushbutton switch SW2 and is responsive to closure, or opening, or both, of the second switch contact P1, P2 for controlling electrical power to the electrical light source LS at least for selectively energizing and de-energizing the electrical light source LS when the battery B is present in the cavity of the housing 200. Thus, electrical light source LS may be selectively energized and de-energized responsive to either or both of the first and second pushbutton switches SW2 without electrical power to energize the light source LS flowing through the first and second pushbutton switches SW2. Either or both of first pushbutton switch SW1 and second pushbutton switch SW2 may comprise: a first switch element 102, 102' including an electrically conductive first flexible dome 150 for providing a first normally open switch contact P1, P2 and having a first given actuating force, and a second switch element 104 adjacent first switch element 102, 102', second switch element 104 including an electrically conductive second flexible dome 170 for providing a second normally open switch contact P1, P2 and having a second given actuating force, second switch element 104 including a flexible electrical conductor between first switch element 102, 102' and the second flexible dome 170; wherein controller 260 may be responsive to closure, or opening, or both, of the first and second normally open switch contacts P1, P2 for controlling the electrical power to the electrical light source LS. Either or both of first pushbutton switch SW1 and second pushbutton switch SW2 may further comprise: an actuator 190 movable for exerting force on second switch element 104 via a spring 180, and for exerting force on first switch element 102, 102' via spring 180 and second switch element 104, wherein actuator 190 moves a distance for closing first and second normally open contacts P1, P2 that may be substantially longer than an actuating distance of the first and second flexible domes 150, 170. The second given actuating force of the second switch element 104 may be less than the first given actuating force of the first switch element 102, 102'. Controller 260 may control electrical power to the electrical light source LS for energizing the electrical light source LS momentarily, for energizing the electrical light source LS continuously, for de-energizing the electrical light source LS, for causing the electrical light source LS to alternate repetitively between energized and de-energized conditions, for causing the electrical light source LS to change from a more energized condition to a less energized condition, for causing the electrical light source LS to change from a less energized condition to a more energized condition, and for any combination of the foregoing. Controller 260 may control the electrical light source LS to momentary ON, to continuous ON, to OFF, to flashing, and to dimming conditions, and optionally to an un-dimming operating condition.

An electrical flashlight 200 may comprise: a housing 200 having a head end and a tail end and having a cavity for receiving a battery B; an electrical light source LS disposed proximate the head end of housing 200; and a first pushbutton switch SW1 disposed proximate the head end of housing 200 for providing at least a first switch contact P1, P2; a second pushbutton switch SW2 disposed proximate the tail end of housing 200 for providing at least a second switch contact P1, P2; a controller 260 disposed in housing 200 and electrically connected to electrical light source LS and to the battery B when a battery B is provided in the cavity of housing 200 for selectively coupling electrical power from the battery B to electrical light source LS, wherein controller 260 is electrically connected to first pushbutton switch SW1 and is responsive to closure, or opening, or both, of the first switch contact P1, P2 for controlling electrical power to electrical light source LS at least for selectively energizing and de-energizing electrical light source LS when the battery B is present in the cavity of housing 200, and wherein controller 260 is electrically connected to second pushbutton switch SW2 and is responsive to closure, or opening, or both, of the second switch contact P1, P2 for controlling electrical power to electrical light source LS at least for selectively energizing and de-energizing electrical light source LS when the battery B is present in the cavity of housing 200. Thus, electrical light source LS of flashlight 200 may be selectively energized and de-energized responsive to either or both of first and second pushbutton switches SW1, SW2 without electrical power to energize the light source LS flowing through the first and second pushbutton switches SW1, SW2. Either or both of first pushbutton switch SW1 and second pushbutton switch SW2 may comprise: a first switch element 102, 102' including an electrically conductive first flexible dome 150 for providing a first normally open switch contact P1, P2 and having a first given actuating force, and a second switch element 104 adjacent first switch element 102, 102', second switch element 104 including an electrically conductive second flexible dome 170 for providing a second normally open switch contact P1, P2 and having a second given actuating force, second switch element 104 including a flexible electrical conductor between first switch element 102, 102' and the second flexible dome 170; wherein controller 260 is responsive to closure, or opening, or both, of the first and second normally open switch contacts P1, P2 for controlling the electrical power to electrical light source LS. Either or both of first pushbutton switch SW1 and second pushbutton switch SW2 may further comprise: an actuator 190 movable for exerting force on second switch element 104 via a spring 180, and for exerting force on first switch element 102, 102' via spring 180 and second switch element 104, wherein actuator 190 moves a distance for closing the first and second normally open contacts P1, P2 that may be substantially longer than an actuating distance of the first and second flexible domes 150, 170. The second given actuating force of the second switch element 104 may be less than the first given actuating force of the first switch element 102, 102'. Controller 260 may control electrical power to electrical light source LS for energizing electrical light source LS momentarily, for energizing electrical light source LS continuously, for de-energizing electrical light source LS, for causing electrical light source LS to alternate repetitively between energized and de-energized conditions, for causing electrical light source LS to change from a more energized condition to a less energized condition, for causing electrical light source LS to change from a less energized condition to a more energized condition, and for any combination of the foregoing. Controller 260 may control electrical light source LS to momentary ON, to continuous ON, to OFF, to flashing, and to dimming conditions, and optionally to an un-dimming operating condition.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

While the present invention has been described in terms of the foregoing example embodiments, variations within the scope and spirit of the present invention as defined by the claims following will be apparent to those skilled in the art. For example, although an example two-pole switch arrangement 100, 100' is described, additional switch elements similar to switch elements 102, 104 could be included between switch element 102 and spring 180, thereby to provide additional switch poles. In such arrangement, the force necessary to actuate the respective switch elements would typically be selected to increase monotonically in relation to the closeness of the switch element to housing base 130, 130'. I.e. the switch element closest to spring 180 would have the lowest actuating force and the switch element closest to base 130, 130' would have the highest actuating force.

While two different example arrangements are shown for connecting a switch 100 in circuit with a processor 260, e.g., as switches SW1, SW2 connected to different inputs of processor 260 in circuit 200, two or more switches could be utilized in either illustrated arrangement, or two or more switches could be utilized in like arrangements connected to the same or different inputs of the same processor, or both switches could be connected in parallel and to the same input of the processor 260, or in any other arrangement as may be convenient or desirable in any given instance.

Notwithstanding that switch 100, 100' is described herein in the context of a flashlight or other portable light, switch 100, 100; may be utilized in and/or with any electrical and/or electronic apparatus, appliance and/or equipment, whether portable or stationary. The specific shape and form of the housing 110, 110', 120, 120', 130, 130' containing switch elements 102, 102', 104 may be varied to suit any particular intended use of a switch arrangement 100 as described.

While electrical leads 140*a*, 140*b*, 160*a*, 160*b* are described as extending through passages defined by respective races 136 of housing base 130 and race covers 126 of housing cover 120, any other arrangement providing a suitable opening may be utilized, e.g., housing cover 120 could provide races and housing base 130 could provide covers.

While switch 100 is described as mounted to an electrical circuit board by electrical leads 140*a*, 140*b*, 160*a*, 160*b* being soldered into corresponding holes therein, connections to electrical leads 140*a*, 140*b*, 160*a*, 160*b* could be made by any other suitable arrangement. For example, wires could be attached to electrical leads 140*a*, 140*b*, 160*a*, 160*b* or electrical leads 140*a*, 140*b*, 160*a*, 160*b* could be bent in two places to have respective end portions disposed in a plane parallel to the bottom of housing base 130 with the end portions soldered to conductors on an electrical circuit board.

Electrical leads 140*a*, 140*b*, 160*a*, 160*b* are illustrated as being provided by bent metal terminals that have a wide end that is swaged to the circuit board 140, 160 and that have a narrow end extending from switch 100, 100' to which an external connection can be made. Alternatively, electrical leads could be provided by wires connected to circuit board 140, 160, or by one or more extensions of circuit board 140, 160 that are shaped and/or formed into a desired shape and orientation, e.g., as by narrow extensions of a flexible substrate 142, 162 onto which conductors 144, 146 extend and that are bent to extend beyond the base 130, 130' of switch 100, 100'.

Finally, numerical values stated are typical or example values, and are not limiting values. Values in any given embodiment may be substantially larger and/or may be substantially smaller than the example or typical values stated.

What is claimed is:

1. An electrical light comprising:

a housing having a cavity for receiving a battery;

an electrical light source disposed in said housing;

a first electrical switch disposed on said housing and including an electrically conductive flexible dome providing at least one switch contact;

a controller disposed in said housing and electrically connected to said electrical light source and to the battery for selectively coupling electrical power from the battery to said electrical light source, wherein said controller is programmable responsive to one or more closures or openings or both of the at least one switch contact of said first electrical switch, or to a time between closure or opening or both of the at least one switch contact of said first electrical switch, or to a time of continuous closure or continuous opening or both of the at least one switch contact of said first electrical switch, or to a combination thereof, for selectively operating said electrical light source in one or more predetermined operating states, and wherein said electrical light source of said electrical light is selectively energizable and de-energizable in one or more predetermined operating states responsive to said first electrical switch.

2. The electrical light of claim 1 further comprising:

a second electrical switch disposed on said housing and including an electrically conductive flexible dome providing at least one switch contact;

wherein said controller is programmable responsive to one or more closures or openings or both of the at least one switch contact of said second electrical switch, or to a time between closure or opening or both of the at least one switch contact of said second electrical switch, or to a time of continuous closure or continuous opening or both of the at least one switch contact of said second electrical switch, or to a combination thereof, for selectively operating said electrical light source in one or more predetermined operating states, and wherein said electrical light source of said electrical light is selectively energizable and de-energizable in one or more predetermined operating states responsive to either or both of said first and second electrical switches.

3. The electrical light of claim 2 wherein: said first electrical switch is disposed toward a head end of said housing; and said second electrical switch is disposed toward a tail end of said housing.

4. The electrical flashlight of claim 2 wherein either or both of said first and second electrical switches comprise:

a switch element including the electrically conductive flexible dome for providing a normally open switch contact and having a given actuating distance; and an actuator movable for exerting force on the electrically conductive flexible dome of said switch element via a spring, wherein said actuator moves a distance for closing the normally open switch contact that is substantially longer than the actuating distance of the flexible dome.

5. The electrical light of claim 1 wherein: said first electrical switch is disposed toward a head end of said housing or is disposed toward a tail end of said housing.

6. The electrical flashlight of claim 1 wherein said first electrical switch comprises:

a switch element including the electrically conductive flexible dome for providing a normally open switch contact and having a given actuating distance, and an actuator movable for exerting force on the electrically conductive flexible dome of said switch element via a spring, wherein said actuator moves a distance for closing the normally open switch contact that is substantially longer than the actuating distance of the flexible dome.

7. The electrical flashlight of claim 1 wherein said controller is programmable to predetermined operating states for energizing said electrical light source momentarily, for energizing said electrical light source continuously, for de-energizing said electrical light source, for causing said electrical light source to alternate repetitively between energized and de-energized conditions, for causing said electrical light source to change from a more energized condition to a less energized condition, for causing said electrical light source to change from a less energized condition to a more energized condition, or for any combination of the foregoing.

8. The electrical flashlight of claim 1 wherein said controller is programmable to control said electrical light source to a momentary ON operating state, to a continuous ON operating state, to an OFF operating state, to a flashing operating state, to a dimmed operating state, or to an un-dimmed operating state, or to any combination thereof.

9. A flashlight comprising:

a housing having a cavity for a battery;

a light emitting diode light source disposed on said housing;

a first electrical switch disposed at a first location of said housing and including an electrically conductive flexible dome providing a switch contact for selectively actuating said light emitting diode light source;

a controller disposed in said housing, wherein said controller is responsive to said first switch for selectively energizing said light emitting diode light source;

wherein said controller, said first electrical switch, said battery and said light emitting diode light source are electrically connected in an electrical circuit;

wherein said controller is programmable responsive to said first electrical switch for controlling electrical power from the battery to said light emitting diode light source for selectively energizing and de-energizing said light emitting diode light source at least in a momentary ON operating state and in a continuous ON operating state;

whereby said light emitting diode light source of said flashlight may be selectively energized and de-energized responsive to said first electrical switch, and wherein said controller is programmable responsive to one or more closures or openings or both of the switch contact of said first electrical switch, or to a time between closure or opening or both of the switch contact of said first electrical switch, or to a time of continuous closure or continuous opening or both of the switch contact of said first electrical switch, or to a combination thereof, for selecting one or more additional operating states for said light emitting diode light source, whereby said flashlight is programmable for selectively operating said light emitting diode light source in one or more predetermined operating states responsive to said first electrical switch.

10. The flashlight of claim 9 further comprising:

a second electrical switch disposed at a second location of said housing and including an electrically conductive flexible dome providing a switch contact for selectively actuating said light emitting diode light source;

wherein said second electrical switch is connected in the electrical circuit with said controller, said first electrical switch, said battery and said light emitting diode light source, wherein said controller is programmable responsive to said second electrical switch for controlling electrical power from the battery to said light emitting diode light source for selectively energizing and de-energizing said light emitting diode light source at least in a momentary ON operating state and in a continuous ON operating state;

wherein said controller is programmable responsive to one or more closures or openings or both of the switch contact of said second electrical switch, or to a time between closure or opening or both of the switch contact of said second electrical switch, or to a time of continuous closure or continuous opening or both of the switch contact of said second electrical switch, or to a combination thereof, for selecting one or more additional operating states for said light emitting diode light source, whereby said flashlight is programmable for selectively operating said light emitting diode light source in one or more predetermined operating states responsive to said first electrical switch, to said second electrical switch or to both said first and second electrical switches.

11. The flashlight of claim 10 wherein applying a first pressure to said first electrical switch or to said second electrical switch causes said light emitting diode light source to produce light and releasing the first pressure causes said light emitting diode light source to cease to produce light, and wherein applying a second pressure greater than the first pressure to said first electrical switch or to said second electrical switch and releasing the greater second pressure causes said light emitting diode light source to continue to produce light.

12. The flashlight of claim 10 wherein either or both of said first electrical switch and said second electrical switch is a pushbutton switch comprising:

the electrically conductive flexible dome; and an actuator movable for exerting force on the electrically conductive flexible dome via a spring, wherein the actuator moves a distance for closing the switch contact provided by the electrically conductive flexible dome that is substantially longer than an actuating distance of the electrically conductive flexible dome.

13. The flashlight of claim 10 wherein said controller selectively energizes and de-energizes said light emitting diode light source responsive to either or both of said first and second electrical switches without electrical power to energize said light emitting diode light source flowing through the first and second electrical switches.

14. The flashlight of claim 9 wherein said controller is programmable for operating said light emitting diode light source in additional operating states including a flashing operating state, in a dimmed operating state, an un-dimmed operating state, or any combination thereof.

15. The flashlight of claim 9 wherein said first electrical switch is a pushbutton switch comprising:

the electrically conductive flexible dome; and an actuator movable for exerting force on the electrically conductive flexible dome via a spring, wherein the actuator moves a distance for closing the switch contact provided by the electrically conductive flexible dome that is substantially longer than an actuating distance of the electrically conductive flexible dome.

16. The flashlight of claim 9 wherein said controller is programmable to control electrical power to said light emitting diode light source for energizing said light emitting diode light source momentarily, or for energizing said light emitting diode light source continuously, or for de-energizing said light emitting diode light source, or for causing said light emitting diode light source to alternate repetitively between energized and de-energized conditions, or for causing said light emitting diode light source to change from a more energized condition to a less energized condition, or for causing said light emitting diode light source to change from a less energized condition to a more energized condition, or for any combination of the foregoing.

17. The flashlight of claim 9 wherein said controller selectively energizes and de-energizes said light emitting diode light source responsive to said first electrical switch without electrical power to energize said light emitting diode light source flowing through the first electrical switch.

18. A flashlight comprising:

a housing including a power source;

a light emitting source in the housing;

an electrical circuit for connecting the power source to the light emitting source, the circuit having a first switch at a location on the housing and a second switch located on a different location on the housing, wherein at least one of said first and second switches includes an electrically conductive flexible dome providing a switch contact; and a controller in the electrical circuit and connected to the power source and to the light emitting source for selectively controlling the operation of the light emitting source, wherein said controller is programmable responsive to one or more closures or openings or both of the switch contact of said first switch and/or of the second switch, or to a time between closure or opening or both of the switch contact of said first switch and/or of said second switch, or to a time of continuous closure or continuous opening or both of the switch contact of said first switch and/or of said second switch, or to a combination thereof, to provide plural predetermined operating states, the operating states including at least a momentary ON operating state, a continuous ON operating state, and a flashing ON operating state and an OFF operating state; and wherein the electrical circuit allows the light emitting source to be programmed into any operating state using the first switch, the second switch or both the first and second switches, and wherein each of the switches operates in the electrical circuit independently of the other switch so as to be able to independently program the light emitting source to any one or ones of the operating states.

19. The flashlight of claim 18 wherein said controller is programmable for operating said light emitting source in dimmed and un-dimmed operating states.

20. The flashlight of claim 18 wherein said controller selectively energizes and de-energizes said light emitting source responsive to either or both of said first and second electrical switches without electrical power to energize said light emitting source flowing through the switch contacts of said first and second electrical switches.

* * * * *